US007165823B2

(12) United States Patent
Yakura et al.

(10) Patent No.: US 7,165,823 B2
(45) Date of Patent: Jan. 23, 2007

(54) METHOD FOR DRIVING RECORDING HEAD, RECORDING HEAD, AND INK JET PRINTER

(75) Inventors: Yuji Yakura, Kanagawa (JP); Makoto Ando, Tokyo (JP); Yuichiro Ikemoto, Kanagawa (JP)

(73) Assignee: Sony Corporation (JP)

( * ) Notice: Subject to any disclaimer, the term of this patent is extended or adjusted under 35 U.S.C. 154(b) by 85 days.

(21) Appl. No.: 10/845,135

(22) Filed: May 14, 2004

(65) Prior Publication Data

US 2004/0212647 A1 Oct. 28, 2004

Related U.S. Application Data

(62) Division of application No. 09/936,943, filed on Jan. 16, 2002, now Pat. No. 6,890,060.

(30) Foreign Application Priority Data

Jan. 20, 2000 (JP) ..... p2000-014236

(51) Int. Cl.
*B41J 28/39* (2006.01)

(52) U.S. Cl. ..... 347/12; 347/41; 347/42

(58) Field of Classification Search ..... 347/12, 347/15, 50, 56, 41, 42, 43
See application file for complete search history.

(56) References Cited

U.S. PATENT DOCUMENTS 4,463,359 A 7/1984 Ayata et al. ..... 347/56
5,600,354 A 2/1997 Hackelman et al. ..... 347/50
5,790,140 A 8/1998 Koizumi et al. ..... 347/12
5,877,786 A 3/1999 Sekiya et al. ..... 347/15
5,975,670 A 11/1999 Kikuta et al. ..... 347/15

(Continued)

FOREIGN PATENT DOCUMENTS

EP 0 517 520 A 12/1992

(Continued)

OTHER PUBLICATIONS

Supplementary EPO Search Report Jun. 16, 2004.

(Continued)

*Primary Examiner*—Manish S. Shah
*Assistant Examiner*—Lam S. Nguyen
(74) *Attorney, Agent, or Firm*—Rader Fishman & Grauer PLLC; Ronald P. Kananen

(57) ABSTRACT

An ink jet printer has a line head having heating elements (121*d*) for ejecting ink droplets from nozzles, in which the plurality of heating elements (121*d*) are arrayed in a direction substantially perpendicular to the paper feed direction. In the line head, the plurality of heating elements (121*d*) are divided into a plurality of blocks, with each block consisting of a predetermined number of spatially arrayed heating elements of the plurality of heating elements (121*d*) corresponding to the plurality of nozzles, and a phase signal PH is sequentially supplied to a set of heating elements (121*d*) simultaneously driven over the respective blocks, thus sequentially driving the respective heating elements (121*d*) by each set as a unit in a time-divisional manner. Thus, the ink jet printer can reduce the positional shift of dots on the paper and can reduce the instantaneous maximum dissipation power in time-division drive.

30 Claims, 29 Drawing Sheets

U.S. PATENT DOCUMENTS 6,149,259 A * 11/2000 Otsuka et al. ..... 347/12

FOREIGN PATENT DOCUMENTS

| | | | |
|---|---|---|---|
| EP | 0 602 582 | A2 | 6/1994 |
| EP | 0 678 386 | A2 | 4/1995 |
| EP | 0 925 924 | A2 | 12/1998 |
| EP | 0 925 924 | A2 | 6/1999 |
| EP | 1 157 844 | A1 | 11/2001 |
| JP | 6-179268 | | 6/1994 |
| JP | 6-255110 | | 9/1994 |
| JP | 7-290707 | | 11/1995 |
| JP | 11-179915 | | 7/1999 |

OTHER PUBLICATIONS

European Patent Office, Application No. 01 901 498.4-2304, Reference No. JBT J10004-4782, Dated May 18, 2006.

* cited by examiner

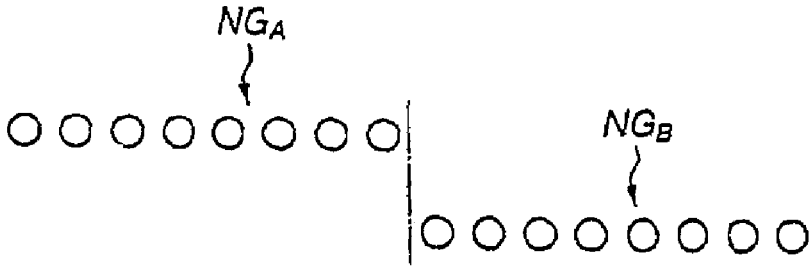
FIG.14
FIG.15A
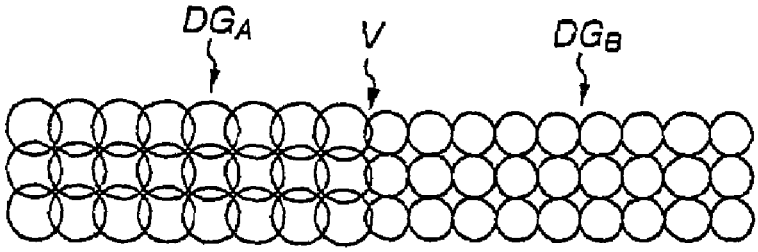
FIG.15B
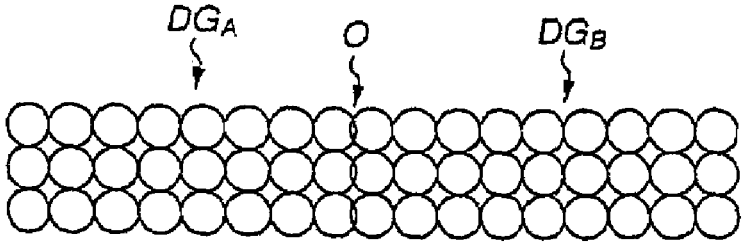
FIG.15C
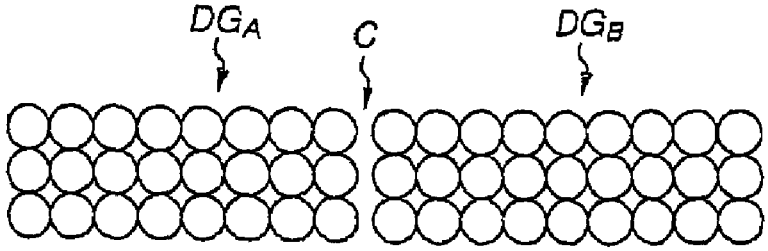
FIG.15D
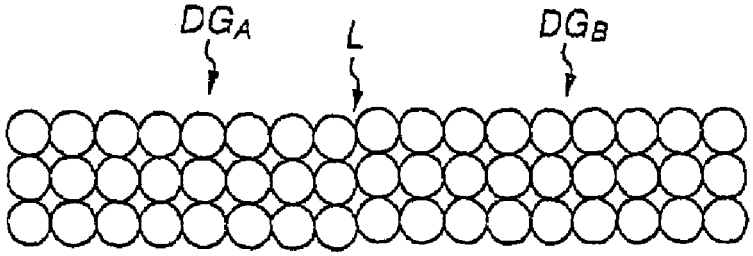

METHOD FOR DRIVING RECORDING HEAD, RECORDING HEAD, AND INK JET PRINTER

RELATED APPLICATION

This application is a divisional application of application Ser. No. 09/936,943, filed on Jan. 16, 2002 now U.S. Pat. No. 6,890,060.

TECHNICAL FIELD

This invention relates to a method for driving a record heading, a record heading, and an ink jet printer for impacting ink droplets on a recording medium and thus recording dots made of the ink droplets on the recording medium.

BACKGROUND ART

A recording device of an ink jet system, that is, an ink jet printer, is a printer of a type which ejects ink droplets for recording from ejection ports of narrow nozzles arrayed on a record heading and impacts the ink droplets on a recording medium such as paper, thus recording characters or images in the form of dots. This ink jet printer is characterized by a high recording speed, a low recording cost and easy realization of color print. As the ink droplet ejection system in this ink jet printer, a thermal system using a heating element as an electrothermal conversion element is known.

The printer of the thermal ink jet system has a recording head which has an ejection port for ejecting flying droplets (hereinafter also referred to as droplets) of ink for recording, an ink flow path communicating with the ejection port, and an electrothermal conversion element provided at a portion of the ink flow path for providing ejection energy for forming droplets. In this ink jet printer, the recording head provides ejection energy to the ink in the ink flow path by applying a drive pulse to the electrothermal conversion element at every arrival of the recording head at a recording position in accordance with the movement thereof, and thus ejects the ink as flying droplets from the ejection port. Then, the ink jet printer impacts the droplets on a recording medium such as paper, thus forming dots thereon. The dots formed on the recording medium constitute a dot matrix in accordance with the movement of the recording head. The ink jet printer records characters and images using the dot matrix.

In the above-described recording device, generally, the recording head has, for example, a plurality of ejection ports in the moving direction (main scanning direction) and in the direction perpendicular to the moving direction (sub scanning direction). The moving direction of the recording head is referred to as "main scanning direction" and the direction perpendicular to the main scanning direction is referred to as "sub scanning direction." In the ink jet printer, though all the electrothermal conversion elements can be simultaneously driven in recording, it is considered to divide the plurality of electrothermal conversion elements into several blocks and carry out time-division drive for sequentially driving the respective divided blocks in a time-divisional manner, in order to avoid a large burden on a power supply unit for supplying power to the recording head.

Moreover, when recording an image or the like on paper as a recording medium, the ink jet printer generally uses image processing such as a so-called dither method or an error diffusion method to express the gray scale and prints the image by pseudo gray scale expression. Normally, various image quality modes are provided in the ink jet printer, and the ink jet printer records one line in the main scanning direction with one nozzle or records one line with a plurality of nozzles by utilizing the movement of the paper fed in the sub scanning direction. Particularly when printing an image of high quality, the ink jet printer uses the latter method for recording with a plurality of nozzles and shorten the moving distance of the paper in the sub scanning direction, thereby making correction so that unevenness in the dot impact position causing a longitudinal stripe in the paper feed direction, that is, a so-called banding noise, becomes inconspicuous.

The recording head in the ink jet printer may be a so-called serial head with a length smaller than the page width of the paper, or a so-called line head with a length substantially equal to the page width of the paper. The line head is a recording head which enables substantially simultaneous recording in the direction of the width of the paper. Unlike the serial head, the line head does not move in the main scanning direction. That is, the ink jet printer having the line head is characterized in that the line head or the paper moves only in the sub scanning direction and that a very large number of nozzles are provided in the longitudinal direction of the line head. For example, with a pitch of 600 dpi (dots per inch), 5100 nozzles per an 8.5-inch width are provided.

Meanwhile, in carrying out multiple gray scale recording in the ink jet printer, the following two problems arise.

The first problem is that the ink jet printer having the line head cannot adopt the recording method used in the ink jet printer having the above-described serial head. As the recording method in the ink jet printer having the line head, it is considered effective to use a PNM (pulse number modulation) system which impacts ink droplets a plurality of times to overlap, thus forming one dot. However, the use of the PNM system increases the number of ejection pulses per pixel, and also in consideration of the number of nozzles in the line head, (number of nozzles) (pulse number) must be controlled in the ink jet printer. Thus, there arises a problem that the dissipation power tends to be larger than in the case of the serial head.

The second problem is that, in the ink jet printer having the line head, since the line head does not move in the main scanning direction, the respective lines print respective lines. Moreover, the ink jet printer having the line head cannot adopt the recording method used in the ink jet printer having the serial head. Therefore, the image quality is deteriorated by nonuniformity, a streak or the like due to the unevenness in the dot impact position on the paper.

Furthermore, since the ink jet printer having the line head carries out the above-described time-division drive, the ink ejection timing differs among the nozzles. Therefore, there arises a problem that a positional shift of dots occurs in the main scanning direction, causing deterioration in the image quality.

DISCLOSURE OF THE INVENTION

In view of the foregoing status of the art, it is an object of the present invention to provide a method for driving a recording head, a recording head, and an ink jet printer which enable reduction in the positional shift of dots on the recording medium and the instantaneous maximum dissipation power in time-division drive.

According to the present invention, there is provided a method for driving a recording head having a plurality of heating elements as driving elements for ejecting ink droplets from a plurality of nozzles, the plurality of heating elements being arranged in a direction substantially perpendicular to the direction of carrying a carried recording medium, the method comprising: a time-division driving step of dividing the plurality of heating elements into a plurality of blocks, each block consisting of a predetermined number of spatially arranged heating elements of the plurality of heating elements corresponding to the plurality of nozzles, and sequentially driving each set of heating elements simultaneously driven over the respective blocks, in a time-divisional manner; and a recording step of ejecting ink droplets from the nozzles corresponding to the driven heating elements and impacting the ink droplets on the recording medium, thus recording dots made of the ink droplets.

In such a method for driving a recording head according to the present invention, each set of heating elements simultaneously driven over the respective divided blocks is sequentially driven in a time-divisional manner.

According to the present invention, there is also provided a recording head having a plurality of heating elements as driving elements for ejecting ink droplets from a plurality of nozzles, the plurality of heating elements being arranged in a direction substantially perpendicular to the direction of carrying a carried recording medium, the recording head comprising: time-division driving means for dividing the plurality of heating elements into a plurality of blocks, each block consisting of a predetermined number of spatially arranged heating elements of the plurality of heating elements corresponding to the plurality of nozzles, and sequentially driving each set of heating elements simultaneously driven over the respective blocks, in a time-divisional manner; and recording means for ejecting ink droplets from the nozzles corresponding to the driven heating elements and impacting the ink droplets on the recording medium, thus recording dots made of the ink droplets.

In such a recording head according to the present invention, each set of heating elements simultaneously driven over the respective divided blocks is sequentially driven in a time-divisional manner.

According to the present invention, there is also provided an ink jet printer having a recording head having a plurality of heating elements as driving elements for ejecting ink droplets from a plurality of nozzles, the plurality of heating elements being arranged in a direction substantially perpendicular to the direction of carrying a carried recording medium, the ink jet printer being adapted for recording information including a character and/or an image in the form of dots made of ink droplets, the ink jet printer comprising: time-division driving means for dividing the plurality of heating elements into a plurality of blocks, each block consisting of a predetermined number of spatially arranged heating elements of the plurality of heating elements corresponding to the plurality of nozzles, and sequentially driving each set of heating elements simultaneously driven over the respective blocks, in a time-divisional manner; and recording means for ejecting ink droplets from the nozzles corresponding to the driven heating elements and impacting the ink droplets on the recording medium, thus recording dots made of the ink droplets.

In such an ink jet printer according to the present invention, the recording head is driven so that each set of heating elements simultaneously driven over the respective divided blocks is sequentially driven in a time-divisional manner.

According to the present invention, there is also provided a method for driving a recording head having a plurality of heating elements as driving elements for ejecting ink droplets from a plurality of nozzles, the plurality of heating elements being arranged in a direction substantially perpendicular to the direction of carrying a carried recording medium, the method comprising: a drive signal generating step of generating an element drive signal made of necessary data for forming one dot so as to modulate the diameter of a dot by the number of ink droplets, using one or a plurality of ink droplets for forming one dot; a time-division driving step of dividing the plurality of heating elements into a plurality of blocks, each block consisting of a predetermined number of spatially arranged heating elements of the plurality of heating elements corresponding to the plurality of nozzles, and sequentially driving each set of heating elements simultaneously driven over the respective blocks, in a time-divisional manner; and a recording step of ejecting one or a plurality of ink droplets from the nozzles corresponding to the driven heating elements and impacting the ink droplet(s) on the recording medium, thus recording dots made of the ink droplet(s).

In such a method for driving a recording head according to the present invention, the heating elements are driven to modulate the diameter of a dot by the number of ink droplets and each set of heating elements simultaneously driven over the respective divided blocks is sequentially driven in a time-divisional manner.

According to the present invention, there is also provided a recording head having a plurality of heating elements as driving elements for ejecting ink droplets from a plurality of nozzles, the plurality of heating elements being arranged in a direction substantially perpendicular to the direction of carrying a carried recording medium, the recording head comprising: drive signal generating means for generating an element drive signal made of necessary data for forming one dot so as to modulate the diameter of a dot by the number of ink droplets, using one or a plurality of ink droplets for forming one dot; time-division driving means for dividing the plurality of heating elements into a plurality of blocks, each block consisting of a predetermined number of spatially arranged heating elements of the plurality of heating elements corresponding to the plurality of nozzles, and sequentially driving each set of heating elements simultaneously driven over the respective blocks, in a time-divisional manner; and recording means for ejecting one or a plurality of ink droplets from the nozzles corresponding to the driven heating elements and impacting the ink droplet(s) on the recording medium, thus recording dots made of the ink droplet(s).

In such a recording head according to the present invention, the heating elements are driven to modulate the diameter of a dot by the number of ink droplets and each set of heating elements simultaneously driven over the respective divided blocks is sequentially driven in a time-divisional manner.

According to the present invention, there is also provided an ink jet printer having a recording head having a plurality of heating elements as driving elements for ejecting ink droplets from a plurality of nozzles, the plurality of heating elements being arranged in a direction substantially perpendicular to the direction of carrying a carried recording medium, the ink jet printer being adapted for recording information including a character and/or an image in the form of dots made of ink droplets, the ink jet printer comprising: drive signal generating means for generating an element drive signal made of necessary data for forming one dot so as to modulate the diameter of a dot by the number of ink droplets, using one or a plurality of ink droplets for forming one dot; time-division driving means for dividing the plurality of heating elements into a plurality of blocks, each block consisting of a predetermined number of spatially arranged heating elements of the plurality of heating elements corresponding to the plurality of nozzles, and sequentially driving each set of heating elements simultaneously driven over the respective blocks, in a time-divisional manner; and recording means of ejecting one or a plurality of ink droplets from the nozzles corresponding to the driven heating elements and impacting the ink droplet(s) on the recording medium, thus recording dots made of the ink droplet(s).

In such an ink jet printer according to the present invention, the recording head is driven so that the heating elements are driven to modulate the diameter of a dot by the number of ink droplets and so that each set of heating elements simultaneously driven over the respective divided blocks is sequentially driven in a time-divisional manner.

BRIEF DESCRIPTION OF THE DRAWINGS

FIG. 14 shows an arrangement of two adjacent groups of nozzles in a conventional line head.

FIG. 15A shows the state of groups of dots recorded by using the head chip of the arrangement shown in FIG. 13 and shows the state where a change point (line) of the diameter of dot is generated on the boundary of groups of dots recorded by using different groups of nozzles.

FIG. 15B shows the state of groups of dots recorded by using the head chip of the arrangement shown in FIG. 13 and shows the state where an overlap of dots is generated on the boundary of groups of dots recorded by using different groups of nozzles.

FIG. 15C shows the state of groups of dots recorded by using the head chip of the arrangement shown in FIG. 13 and shows the state where a gap between dots is generated on the boundary of groups of dots recorded by using different groups of nozzles.

FIG. 15D shows the state of groups of dots recorded by using the head chip of the arrangement shown in FIG. 13 and shows the state where a step between dots is generated on the boundary of groups of dots recorded by using different groups of nozzles.

BEST MODE FOR CARRYING OUT THE INVENTION

Preferred embodiments of the present invention will now be described in detail with reference to the drawings.

This embodiment is applied to an ink jet printer which employs a thermal system for ejecting ink droplets and which has, as a recording head, a line head having heating elements as driving elements for ejecting ink droplets in which the plurality of heating elements are arrayed in a direction substantially perpendicular to the feed direction of paper as a recording medium. This ink jet printer has the line head and thus can carry out recording by scanning the same portion on the paper only once in one print. Moreover, in this ink jet printer, the plurality of heating elements provided in the line head are divided into a plurality of blocks, each block consisting of a predetermined number of spatially arranged heating elements, and time-division drive is carried out at the time of recording, in which each set of heating elements simultaneously driven over the respective blocks is sequentially driven in a time-divisional manner. Thus, it is possible to reduce the positional shift of dots on the paper as a recording medium and the instantaneous maximum dissipation power in time-division drive.

Prior to explanation of the specific constitution of the ink jet printer, the basic operation of time-division drive will be described by using a simple example. As will be later described in detail, the ink jet printer has a structure in which a line head for one color has a plurality of head chips and each head chip has heating elements corresponding to a plurality of nozzles for ejecting ink droplets arrayed substantially in a straight line. Therefore, time-division drive is explained by showing the nozzles in place of the heating elements.

Figure 1:
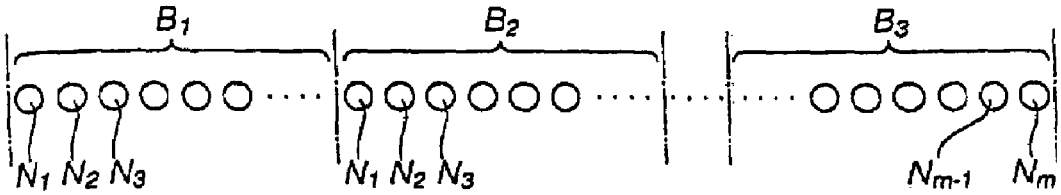
FIG. 1 schematically shows a nozzle arrangement in a line head provided in an ink jet printer as an embodiment of the present invention, in which a plurality of nozzles are sectioned by a predetermined number to constitute a block.

In the ink jet printer, as schematically shown in FIG. 1, a plurality of nozzles are arrayed substantially in a straight line in the head chip, and the plurality of nozzles are sectioned by a predetermined number and divided into a plurality of blocks. In FIG. 1, the blocks are denoted by $B_1$, $_{B2}$, . . . , $B_n$ from left and the nozzles in each block are denoted by $N_1$, $N_2$, $N_3$, . . . , $N_{m-1}$, $N_m$ from left. In the ink jet printer, the respective nozzles (heating elements) in the respective blocks are sequentially driven in a time-divisional manner. In this case, in the ink jet printer, the positions of the nozzles (heating elements) in the respective blocks are considered as phases. The nozzles (heating elements) of the same phase are grouped as a set and ink droplets are sequentially ejected by each set as a unit. In the description, a nozzle Ni in each block is referred to as a nozzle of the i-th phase, if necessary.

Figure 2:
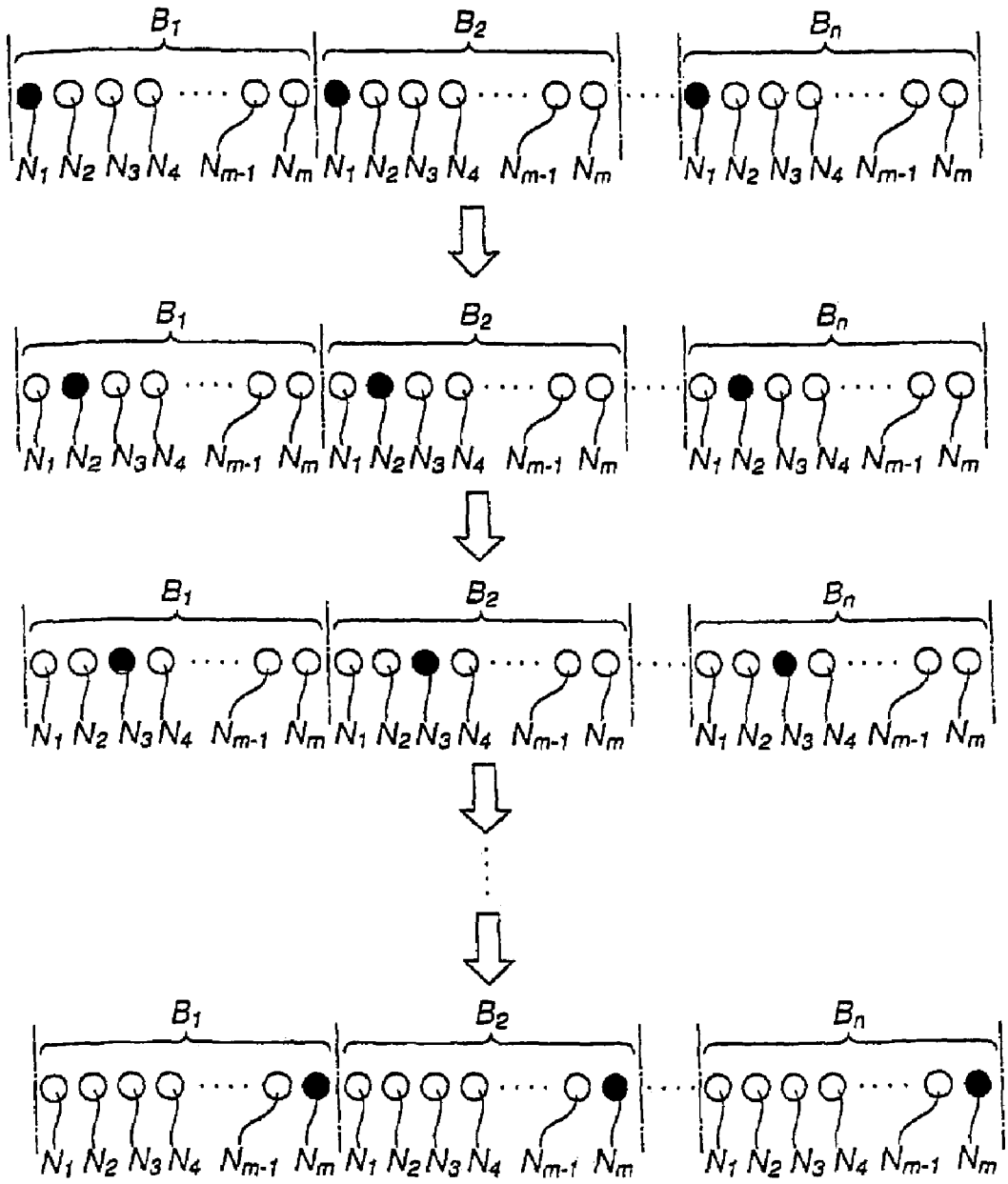
FIG. 2 shows the basic operation of time-division drive in the ink jet printer, in which ink droplets are ejected from the nozzles for each phase.

Specifically, in the ink jet printer, ejection of ink droplets is made possible from the nozzles $N_1$ of the first phase in the respective blocks, as shown in the top stage in FIG. 2. In FIG. 2, the nozzles allowed to eject ink droplets are denoted by "●." That is, in the ink jet printer, data for the n nozzles $N_1$ corresponding to the number of blocks are supplied to the head chips and whether or not to drive the n heating elements corresponding to the n nozzles $N_1$ is determined. Thus, ink droplets are ejected or not ejected from the respective nozzles $N_1$.

Subsequently, in the ink jet printer, ejection of ink droplets is made possible from the nozzles $N_2$ of the second phase in the respective blocks, as shown in the second stage in FIG. 2. That is, in the ink jet printer, data for the n nozzles $N_2$ are supplied to the head chips and whether or not to drive the n heating elements corresponding to the n nozzles $N_2$ is determined. Thus, ink droplets are ejected or not ejected from the respective nozzles $N_2$.

Next, in the ink jet printer, ejection of ink droplets is made possible from the nozzles $N_3$ of the third phase in the respective blocks, as shown in the third stage in FIG. 2. That is, in the ink jet printer, data for the n nozzles $N_3$ are supplied to the head chips and whether or not to drive the n heating elements corresponding to the n nozzles $N_3$ is determined. Thus, ink droplets are ejected or not ejected from the respective nozzles $N_3$.

Then, in the ink jet printer, the similar operation is sequentially carried out and ejection of ink droplets is made possible from the nozzles $N_m$ of the m-th phase in the respective blocks, as shown in the bottom stage in FIG. 2. That is, in the ink jet printer, data for the n nozzles $N_m$ are supplied to the head chips and whether or not to drive the n heating elements corresponding to the n nozzles $N_m$ is determined. Thus, ink droplets are ejected or not ejected from the respective nozzles $N_m$.

In this manner, in the ink jet printer, the plurality of heating elements corresponding to the plurality of nozzles are divided into the plurality of blocks and the heating elements of the same phase are sequentially driven, thus realizing time-division drive. By carrying out such processing, the ink jet printer can realize time-division drive of m divisions. For example, the ink jet printer can carry out time-division drive of 64 divisions by dividing the heating elements in one head chip into 7 blocks, with one block consisting of 64 heating elements corresponding to 64 nozzles. The ink jet printer carries out such processing with respect to the plurality of head chips in the line head in printing one line, and also with respect to the line heads for all colors. When carrying out PNM (pulse number modulation), which will be later described, the ink jet printer additionally carries out such processing by the number of ejection pulses per pixel.

In this description, the adjacent nozzles such as the nozzles $N_1$ of the first phase, the nozzles $N_2$ of the second phase, the nozzles $N_3$ of the third phase, . . . , the nozzles $N_m$ of the m-th phase are sequentially driven, as a matter of convenience. However, in order to avoid the influence of cross talk due to the driving of the adjacent heating elements, the driving order may be changed to shuffle so that the distant heating elements are driven next. In this case, too, the ink jet printer drives the nozzles of the same phase in the respective blocks.

A specific ink jet printer using such time-division drive will now be described in detail.

Figure 3:
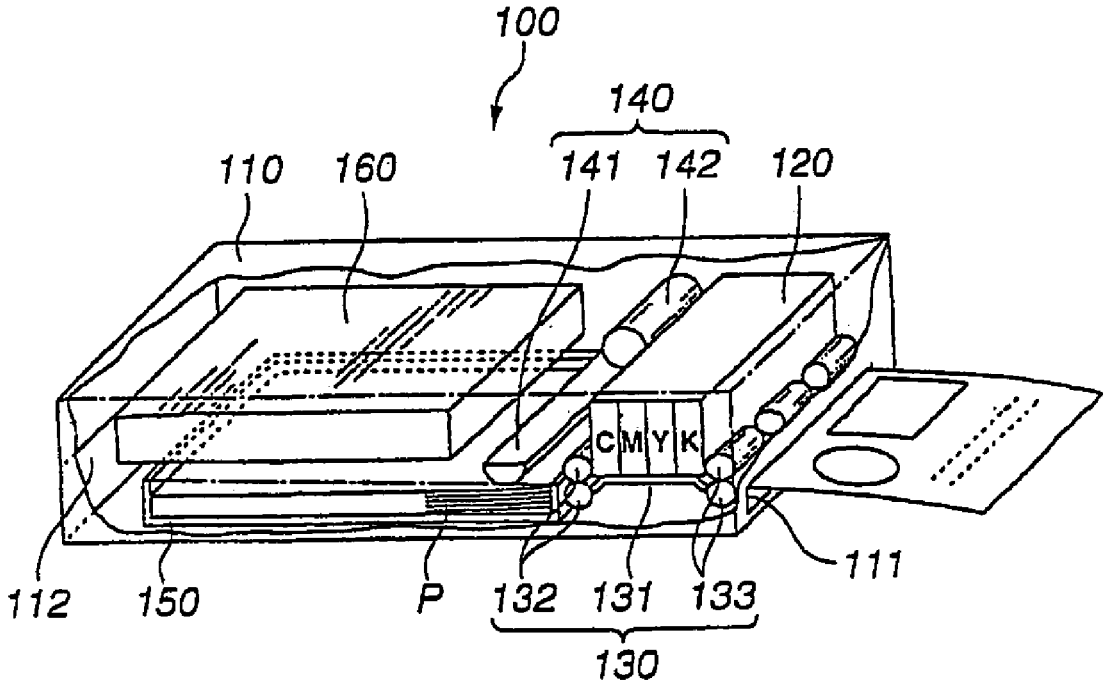
FIG. 3 is a partial cross-sectional perspective view showing the overall structure of an ink jet printer as a first embodiment of the present invention.

FIG. 3 shows the overall structure of an ink jet printer 100 as a first embodiment. The ink jet printer 100 has a recording head having a PNM function to modulate the diameter of a dot by the number of ink droplets, using one or a plurality of ink droplets for forming one dot.

Figure 4:
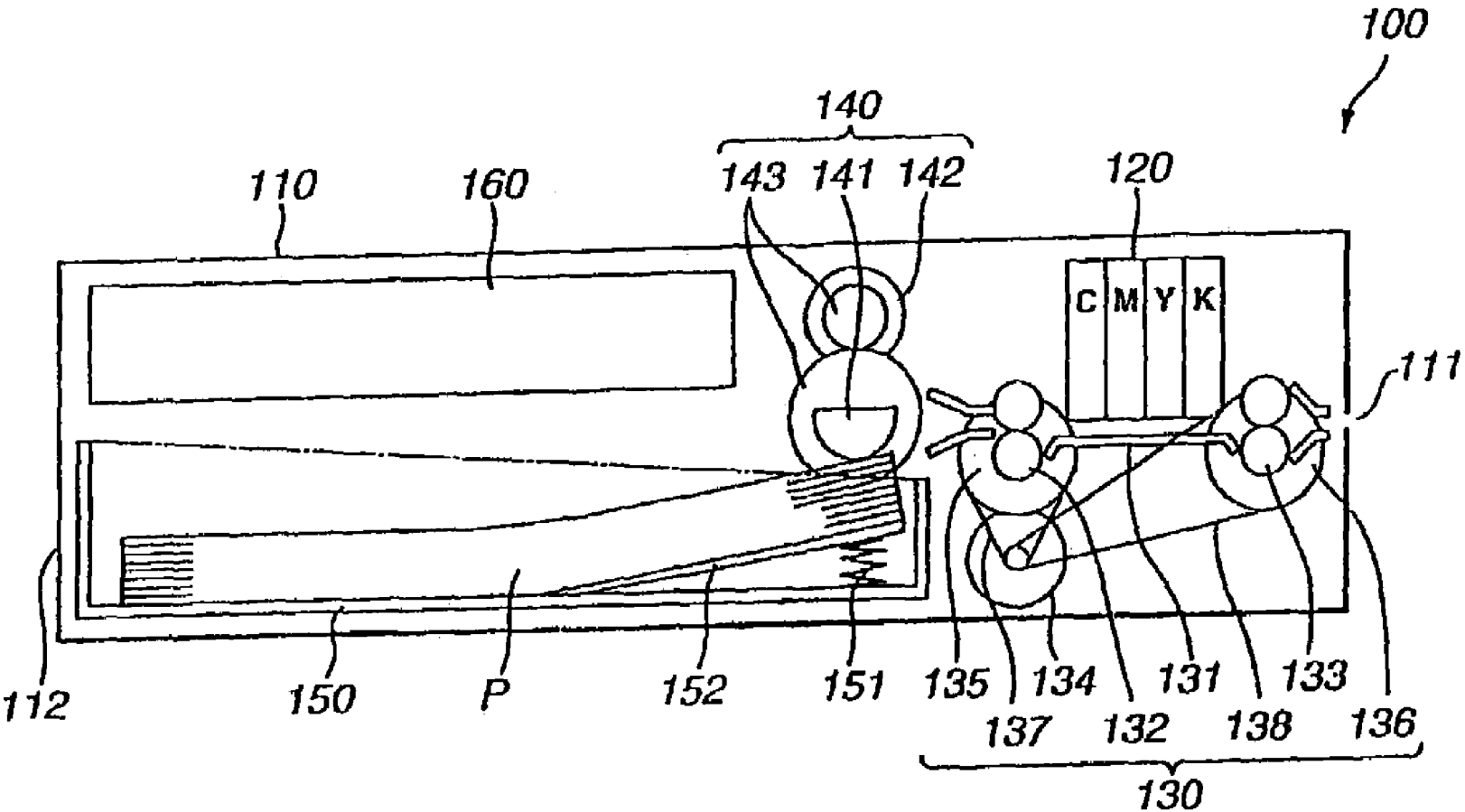
FIG. 4 is a cross-sectional side view showing the ink jet printer.

The ink jet printer 100 has a line head 120 having a recording range of substantially the same dimension as the page width of the paper P, a paper feed unit 130 for feeding the paper P into a predetermined direction, a paper charge unit 140 for supplying the paper P to the line head 120, a paper tray 150 for housing the paper P, and an electric circuit unit 160 for carrying out drive control of these units, which are provided inside a casing 110 constituting the appearance of the ink jet printer 100, as shown in FIGS. 3 and 4.

The casing 110 is formed, for example, in the shape of a rectangular parallelepiped. A paper discharge port 111 for discharging the paper P is provided on one lateral side of the lateral sides of the casing 110, and a tray inlet/outlet 112 for attaching/detaching the paper tray 150 is provided on another lateral side that is opposite to the one lateral side.

The line heads 120 for four colors, for example, CMYK (cyan, magenta, yellow and black), are provided. The line heads 120 are provided in an upper space at the end on the side of the paper discharge port 111 inside the casing 110, with the nozzles facing downward, though not shown.

The paper feed unit 130 has the following constituent elements: a paper feed guide 131 constituting a supply path in feeding the paper P; paper feed rollers 132, 133 for catching the paper P between them and feeding the paper P; a paper feed motor 134 as a driving source for rotationally driving later-described pulleys 135, 136; pulleys 135, 136 for rotationally driving the rollers 132, 133; and belts 137, 138 for transmitting the driving of the paper feed motor 134 to the pulleys 135, 136. The paper feed unit 130 is provided in a lower space at the end on the side of the paper discharge port 111 inside the casing 110. The paper feed guide 131 is formed in the shape of a flat plate and is provided at a predetermined spacing below the line head 120. Each of the paper feed rollers 132, 133 consists of a pair of rollers contacting each other. The paper feed rollers 132, 133 are provided on both sides of the paper feed guide 131, that is, on the side of the tray inlet/outlet 112 and on the side of the paper discharge port 111, respectively. The paper feed motor 134 is provided below the paper feed guide 131 and is connected with the paper feed rollers 132, 133 via the pulleys 135, 136 and the belts 137, 138.

The paper charge unit 140 has a paper charge roller 141 for supplying the paper P to the paper feed unit 130, a paper charge motor 142 as a driving source for rotationally driving later-described gears 143, and gears 143 rotationally driven by the paper charge motor 142. The paper charge unit 140 is provided nearer to the tray inlet/outlet 112 than the paper feed unit 130 is. The paper charge roller 141 is formed in a substantially semi-cylindrical shape and is provided near the paper feed rollers 132 on the side of the tray inlet/outlet 112. The paper charge motor 142 is provided above the paper charge roller 141 and is connected with the paper charge roller 141 via the gears 143.

The paper tray 150 is formed in a box-like shape capable of housing a plurality of stacked sheets of paper P of A4 size. The paper tray 150 has a paper support 152 which is retained by a spring 151 at one end portion on the bottom side thereof. The paper tray 150 is loaded in a space ranging from below the paper charge unit 140 to the tray inlet/outlet 112.

The electric circuit unit 160 is a unit for controlling the driving of each section and is provided above the paper tray 150.

The ink jet printer 100 as described above carries out the printing operation in the following manner.

First, a user turns on the power of the ink jet printer 100, then pulls out the paper tray 150 from the tray inlet/outlet 112 to put a predetermined number of sheets of paper P therein, and pushes the paper tray 150 in the tray inlet/outlet 112, thus loading the paper tray 150. Then, in the ink jet printer 100, the energizing force of the spring 151 causes the paper support 152 to raise one end portion of the paper P, thus pushing the one end portion of the paper P against the paper charge roller 141. Then, in the ink jet printer 100, the driving of the paper charge motor 142 rotationally drives the paper charge roller 141, thus feeding one sheet of paper P from the paper tray 150 to the paper feed rollers 132.

Subsequently, in the ink jet printer 100, the driving of the paper feed motor 134 rotationally drives the paper feed rollers 132, 133, and the pair of paper feed rollers 132 catch the paper P fed from the paper tray 150, thus feeding the paper to the paper feed guide 131. Then, in the ink jet printer 100, the line head 120 operates at predetermined timing to eject ink droplets from the nozzles and impact the ink droplets on the paper P, thus recording information including a character and/or an image in the form of dots on the paper P. Then, in the ink jet printer 100, the pair of paper feed rollers 133 catch the paper P fed along the paper feed guide 131, thus discharging the paper P from the paper discharge port 111.

The ink jet printer 100 repeats such an operation to generate prints until the recording is completed.

The electric circuit unit 160 in the ink jet printer 100 will now be described.

Figure 5:
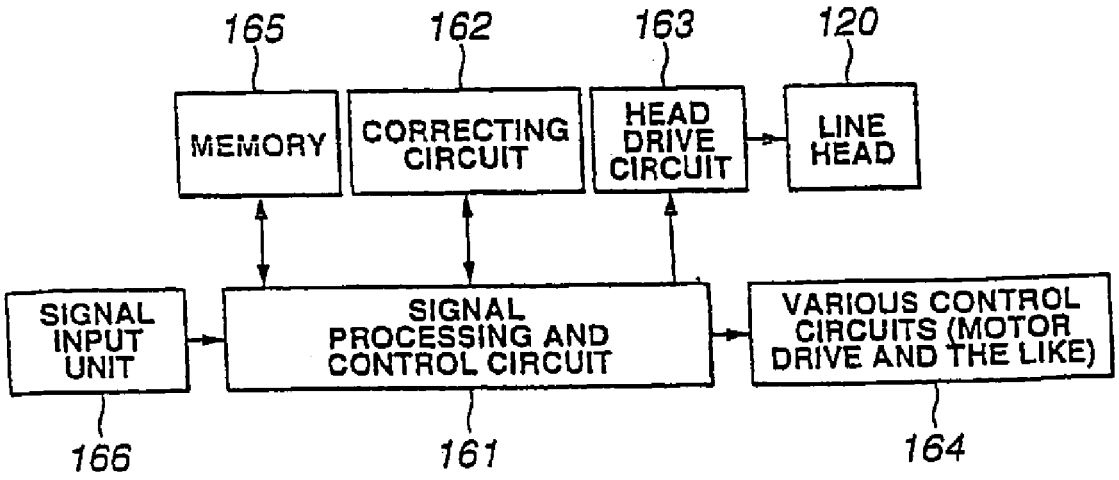
FIG. 5 is a block diagram showing the structure of a recording and control system of an electric circuit unit in the ink jet printer.

As shown in FIG. 5, the electric circuit unit 160 has the following constituent elements: a signal processing and control circuit 161 for carrying out signal processing and control processing based on software, for example, as the configuration of a CPU (central processing unit) and a DSP (digital signal processor); a correcting circuit 162 in which predetermined correction data is stored in a so-called ROM (read only memory) map system; a head drive circuit 163 for driving the line head 120; a various control circuit 164 for controlling the driving of the paper feed motor 134 and the paper charge motor 142, and other operations; a memory 165 such as a line buffer memory or a one-screen memory; and a signal input section 166 to which signals of recording data or the like are inputted. The signal processing and control circuit 161 is connected with the correcting circuit 162, the head drive circuit 163, the various control circuit 164 and the memory 165.

In the electric circuit unit 160, when signals of recording data or the like are inputted to the signal processing and control circuit 161 via the signal input section 166, these signals arranged in the recording order by the signal processing and control circuit 161 and are supplied to the correcting circuit 162. The correction circuit 162 carries out correction processing such as so-called gamma correction, color correction, and correction of nozzle dispersion. The signals of recording data or the like after the correction are taken out by the signal processing and control circuit 161 in accordance with external conditions such as nozzle number, temperature, and input signals. Then, in the electric circuit unit 160, the signals taken out by the signal processing and control circuit 161 are supplied as drive signals to the head drive circuit 163 and the various control circuit 164. The electric circuit unit 160 causes the head drive circuit 163 to control the driving of the line head 120 in accordance with the drive signal. The electric circuit unit 160 causes the various control circuit 164 to control the driving of the paper feed motor 134 and the paper charge motor 142 in accordance with the drive signal and also to control the driving in the cleaning processing of the line head 120. In the electric circuit unit 160, when necessary, the signals of recording data or the like are temporarily recorded in the memory 165 and taken out by the signal processing and control circuit 161.

Figure 6:
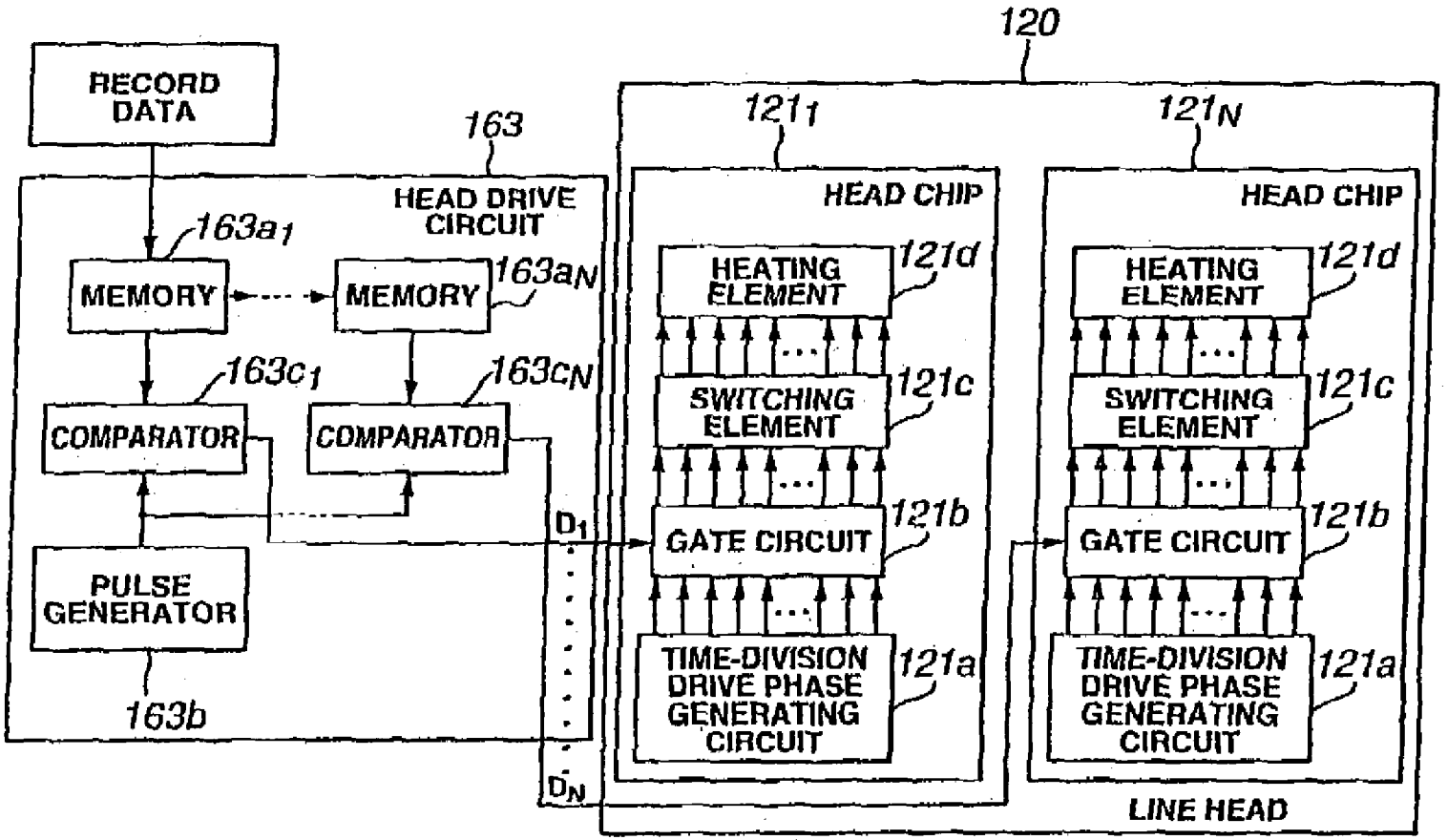
FIG. 6 is a block diagram showing the detailed structure of a head drive circuit shown in FIG. 5 and a line head.

FIG. 6 shows the details of the structures of the head drive circuit 163 and the line head 120.

As shown in FIG. 6, the head drive circuit 163 has a structure adapted for carrying out PNM and later-described time-division drive, and a plurality of memories 163$a_1$, . . . , 163$a_N$ such as RAMs (random access memories), a pulse generator 163*b*, and a plurality of comparators 163$c_1$, . . . , 163$c_N$.

The memories 163$a_1$, . . . , 163$a_N$ of the same number as the number of head chips 1211, . . . , 121N in the line head 120 are provided. Each of the memories 163$a_1$, . . . , 163$a_N$ stores record data after corrected based on a drive signal supplied from the signal processing and control circuit 161. In this case, the record data is necessary data for forming one dot. Since the ink jet printer 100 forms one dot using 8 ink droplets at the maximum, as will be described later, the record data is 4-bit data presenting any value of 0 to 8 including the case of ejecting no ink droplets. The memories 163$a_1$, . . . , 163$a_N$ supply the stored data to the corresponding comparators 163$c_1$, . . . , 163$c_N$, respectively.

Figure 7:
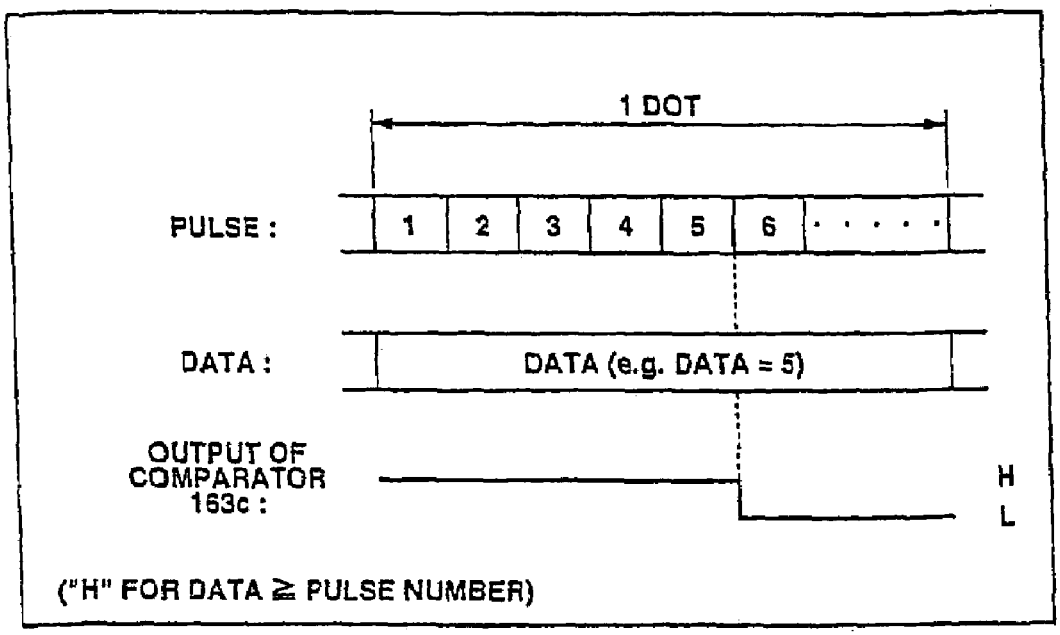
FIG. 7 illustrates PNM (pulse number modulation) processing by the head drive circuit shown in FIG. 6, and shows the relation between a pulse generated by a pulse generator provided in the head drive circuit, record data stored in a memory provided in the head drive circuit, and a signal outputted from a comparator provided in the head drive circuit.

The pulse generator 163*b* generates a predetermined number of pulses for carrying out PNM, at predetermined intervals, as shown in FIG. 7. For example, the pulse generator 163*b* constantly spontaneously generates eight pulses at predetermined intervals. That is, the head drive circuit 163 determines the number of ink droplets to be ejected and determines the arrangement of dots for each gray scale, on the basis of the pulses generated by the pulse generator 163*b*. The pulse generator 163*b* supplies the generated pulses to the comparators 163$c_1$, . . . , 163$c_N$.

The comparators 163$c_1$, . . . , 163$c_N$ receive the record data stored by the memories 163$a_1$, . . . , 163$a_N$, respectively, and also receive the pulse number generated by the pulse generator 163*b*. The comparators 163$c_1$, . . . , 163$c_N$ compare the data with the pulse number. If the result of comparison shows that the data is not less than the pulse number, the comparators 163$c_1$, . . . , 163$c_N$ supply a high signal "H" as output data to the corresponding head chips 121$_1$, . . . , 121$_N$ in the line head 120, as shown in FIG. 7. If the data is less than the pulse number, the comparators 163$c_1$, . . . , 163$c_N$ output a low signal "L" as output data to the corresponding head chips 121$_1$, . . . , 121$_N$.

Figure 8:
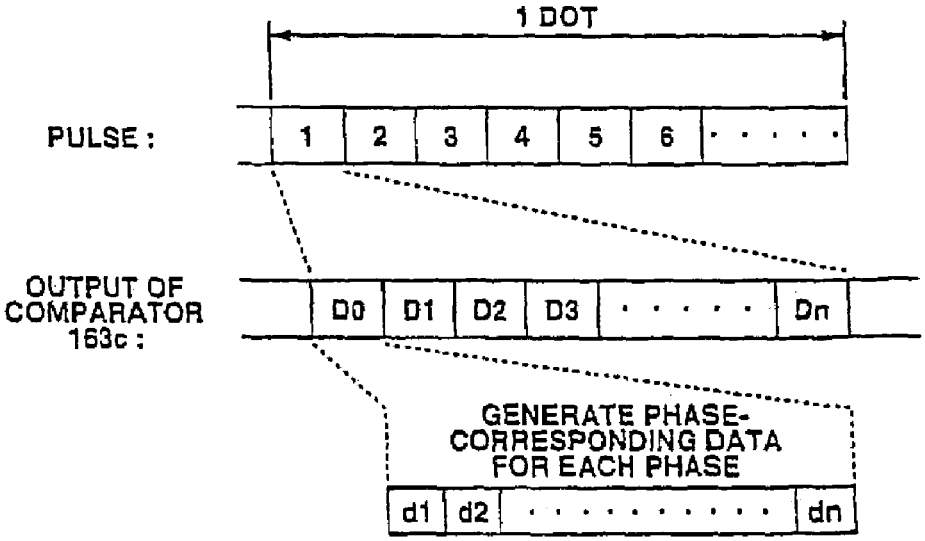
FIG. 8 illustrates PNM processing by the head drive circuit shown in FIG. 6, and shows the operation at the comparator provided in the head drive circuit.

In this case, the comparators 163$c_1$, . . . , 163$c_N$ generate a high signal "H" or a low signal "L" as phase-corresponding data d1, d2, . . . , dn, which are element drive signals corresponding to the plurality of heating elements of the same phases in the above-described time-division drive, and handle the phase-corresponding data d1, d2, . . . , dn as a series of serial data, thus supplying output data D1, . . . , DN to the corresponding head chips 121$_1$, . . . , 121$_N$, as shown in FIG. 8. For example, when data for a certain heating element is "5," the comparator 163$c_1$ generates a high signal "H" as phase-corresponding data d with respect to the pulse numbers "1 to 5" generated by the pulse generator 163*b* and generates a low signal "L" as phase-corresponding data d with respect to the pulse number "6" and larger pulse numbers, as shown in FIG. 7. The comparator 163$c_1$ generates phase-corresponding data d corresponding to the respective heating elements of the same phase and supplies the phase-corresponding data d as output data D0. In this manner, the comparators 163$c_1$, . . . , 163$c_N$ process, as a series of serial data, the data of the heating elements simultaneously driven by the number of time divisions of time-division drive within one gray scale, and supply the data as output data D1, . . . , DN to the corresponding head chips 121$_1$, . . . , 121$_N$, respectively.

Meanwhile, the line head 120 has a plurality of head chips 121$_1$, . . . , 121$_N$, as shown in FIG. 6. In each head chip 121, a plurality of parts for constituting one block in time-division drive are tiled. Specifically, the head chips 121$_1$, . . . , 121$_N$ have time-division drive phase generating circuits 121*a*, gate circuits 121*b*, switching elements 121*c* and heating elements 121*d*, which are divided into a plurality of blocks in time-division drive.

The time-division drive phase generating circuit 121*a* has outputs of the same number as the total number of nozzles, which is equal to (total number of phase m) (number of blocks n). The time-division drive phase generating circuit 121*a* sequentially generates a phase signal, which is a division drive signal, for each phase to be driven, and supplies the phase signal to the gate circuit 121*b*.

The gate circuit 121*b* is a so-called AND gate, which takes the logical product of the phase signal supplied from the time-division drive phase generating circuit 121*a* and the data supplied from the comparators 163$c_1$, . . . , 163$c_N$, that is, the phase-corresponding data. If both the phase signal supplied from the time-division drive phase generating circuit 121*a* and the phase-corresponding data supplied from the comparators 163$c_1$, . . . , 163$c_N$ are high signals "H," the gate circuit 121*b* turns the switching element 121*c* ON.

The switching element 121*c* is adapted for switching whether to drive the heating elements 121*d* to eject ink droplets from the nozzles. The ON/OFF control of the switching element 121*c* is carried out by the gate circuit 121*b*.

The heating elements 121*d* are driven to heat and causes ejection of ink droplets from the corresponding nozzles, when the switching element 121*c* is in the ON state.

In the ink jet printer 100 of the above-described structure, the comparators 163$c_1$, . . . , 163$c_N$ generate the phase-corresponding data d1, d2, . . . , dn corresponding to the respective blocks $B_1$, $B_2$, . . . , $B_n$ in one head chip 121, for each pulse generated by the pulse generator 163*b*, and handle the phase-corresponding data d1, d2, . . . , dn as a series serial data, thus supplying the output data D to the one head chip 120, as shown in FIG. 8. In the ink jet printer 100, such output data D1, . . . , DN are supplied to the plurality of head chips 121$_1$, . . . , 121$_N$.

In response to this, in the ink jet printer 100, the phase signals for respective phases are sequentially generated by the time-division drive phase generating circuit 121*a*, ejection or non-ejection of an ink droplet for 1 pulse, that is, one ink droplet, is carried out with respect to all the nozzles N. In this case, the time-division drive phase generating circuit 121*a* sequentially generates the phase signals for the respective phases so as to carry out drive processing of the heating elements 121*d* corresponding to the nozzles N1 in the respective blocks $B_1$, $B_2$, . . . , $B_n$ and then carry out driving processing of the heating elements 121*d* corresponding to the nozzles $N_2$ in the respective blocks $B_1$, $B_2$, . . . , $B_n$.

The ink jet printer 100 repeats such an operation for each pulse generated by the pulse generator 163*a*, thus forming one dot having a diameter corresponding to the pulse number.

By doing so, the ink jet printer 100 can simultaneously realize PNM and time-division drive. The PNM operation in the ink jet printer 100 will be later described further in detail.

The structure of the line head 120 in the ink jet printer 100 will now be described in detail.

Figure 9A:
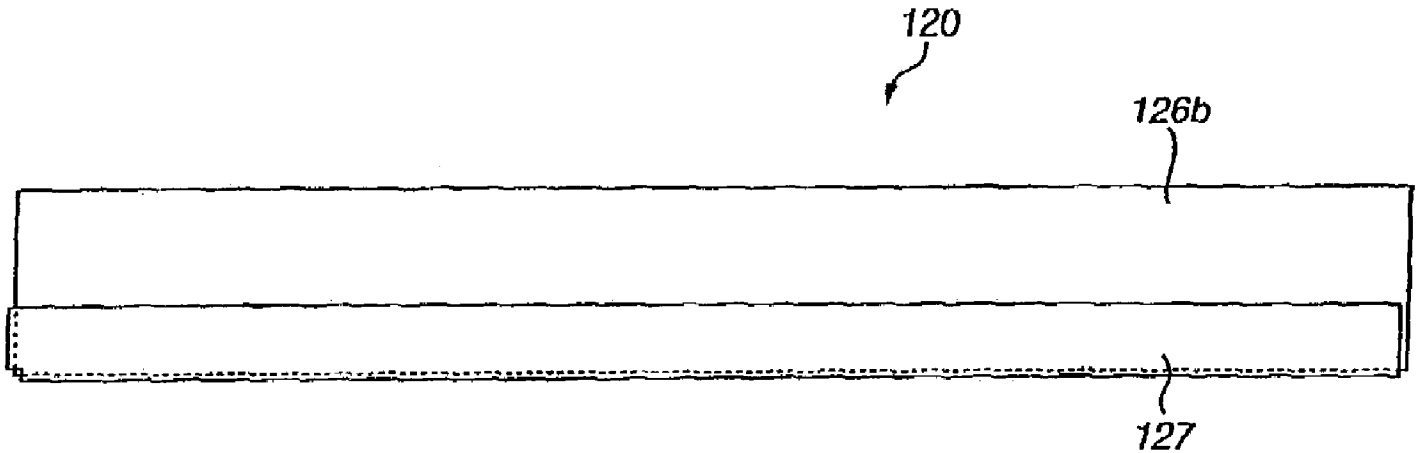
FIG. 9A is an outer side view for explaining the structure of the line head for one color.
Figure 9B:
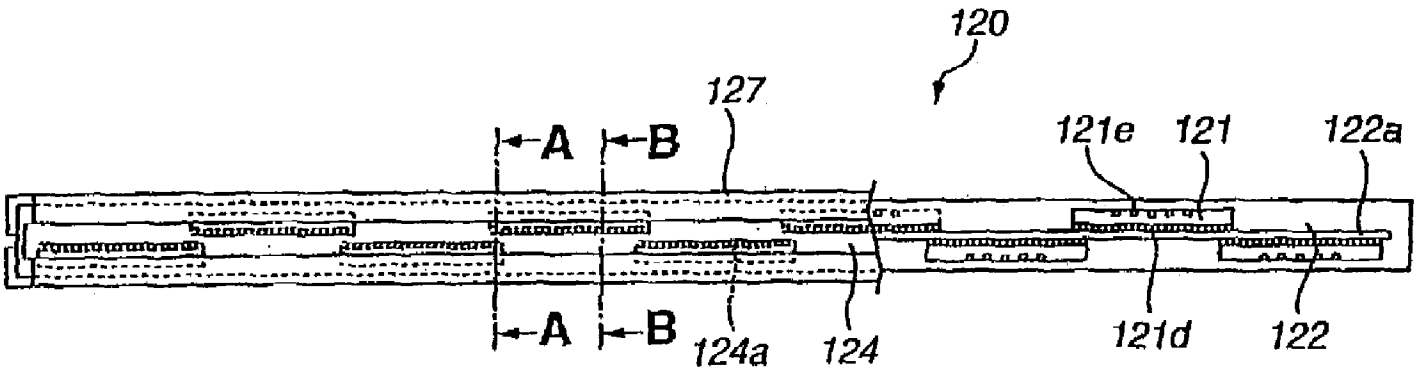
FIG. 9B is an outer bottom view for explaining the structure of the line head for one color.
Figure 10:
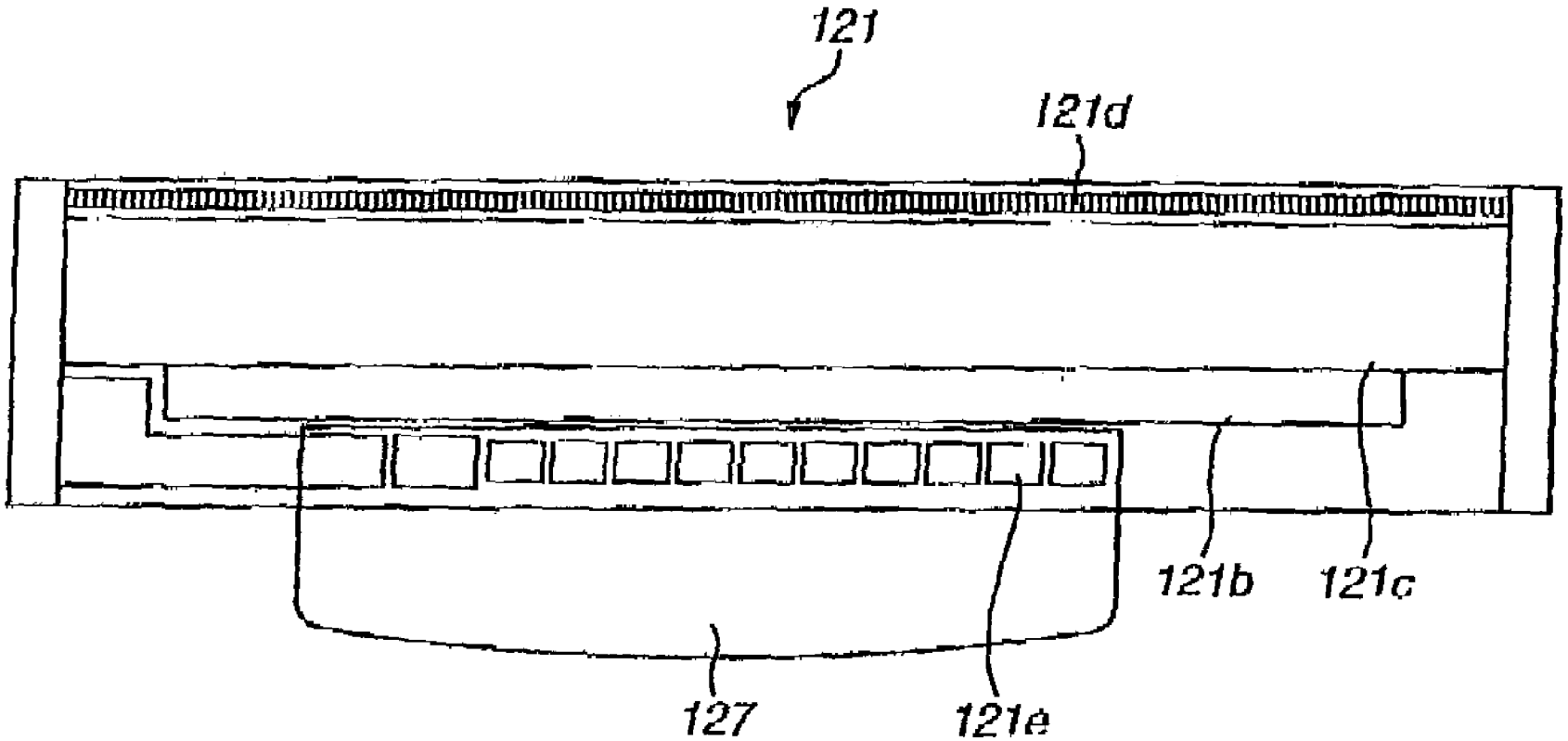
FIG. 10 illustrates the detailed structure of a head chip.
Figure 11A:
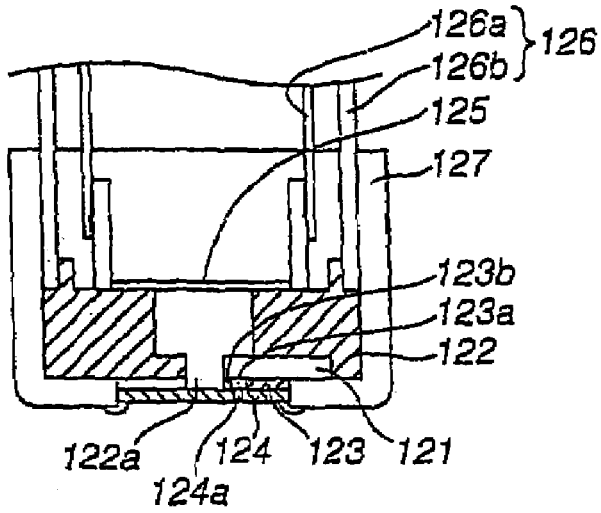
FIG. 11A is a side view showing a cross section along a line A—A in the line head of FIG. 9B.
Figure 11B:
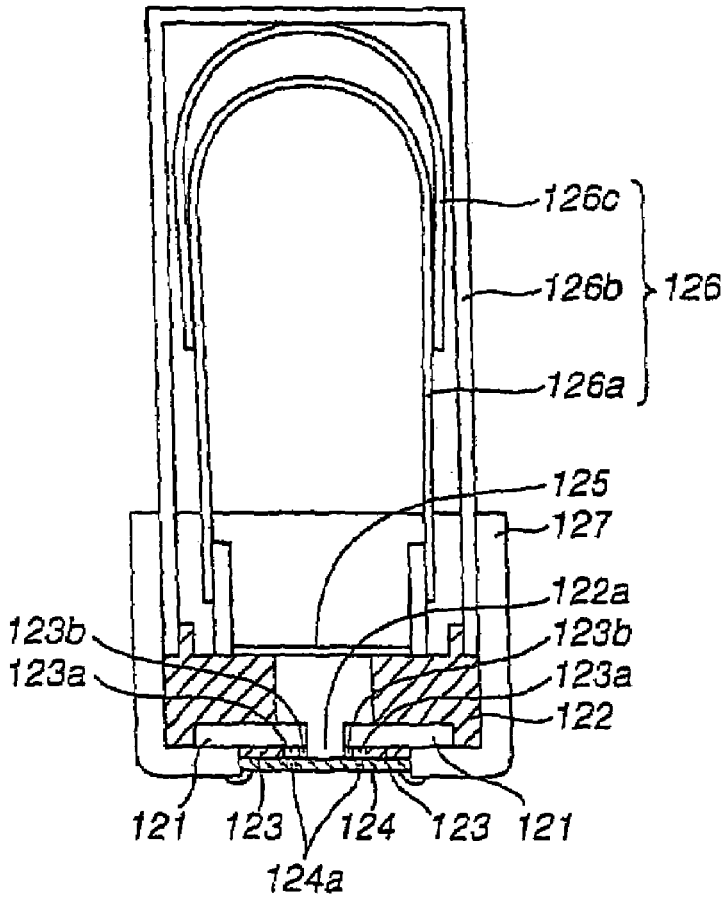
FIG. 11B is a side view showing a cross section along a line B—B in the line head of FIG. 9B.
Figure 12:
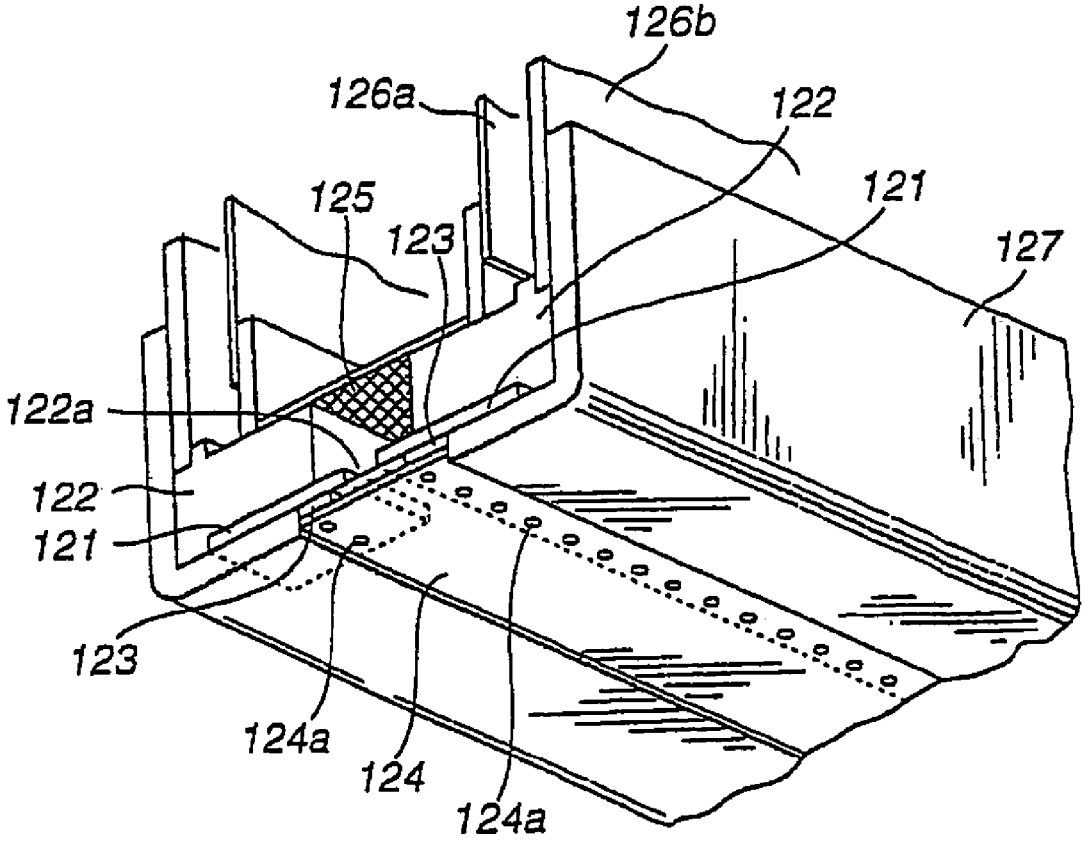
FIG. 12 is a partial perspective view showing the line head of FIGS. 9A and 9B from the bottom side.
Figure 13:
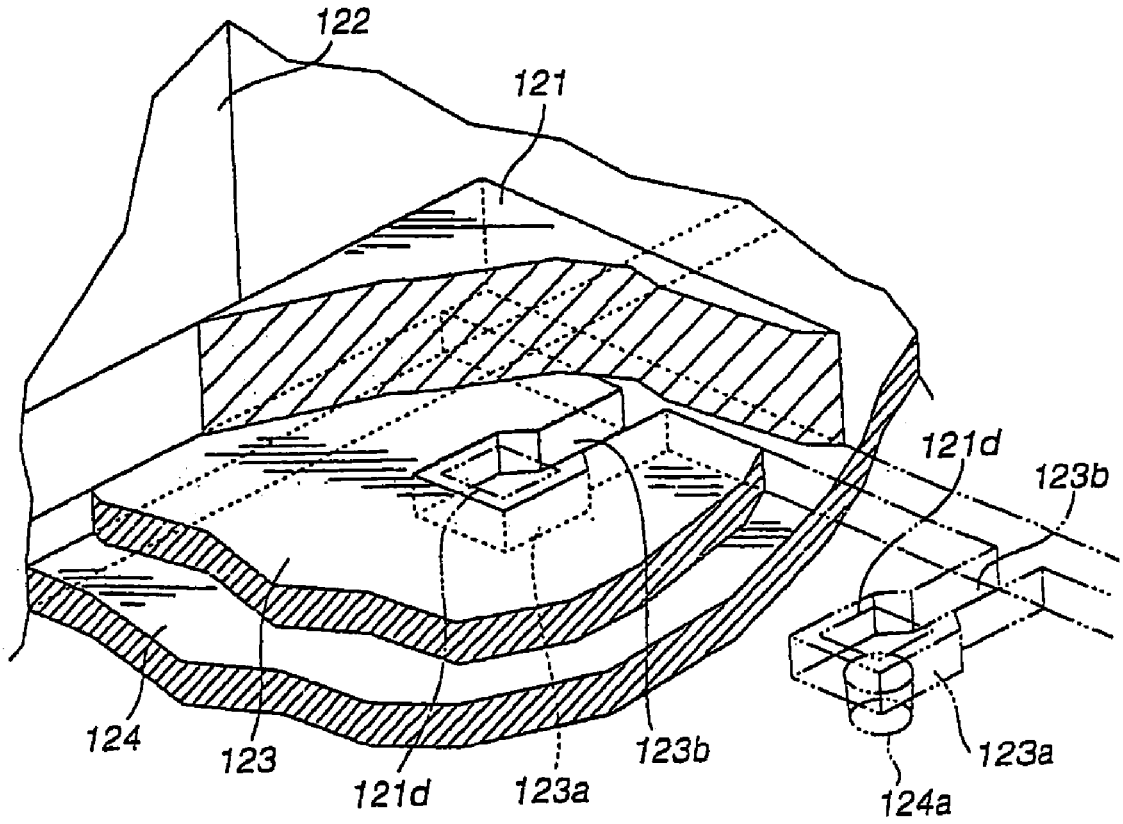
FIG. 13 is a partial perspective view showing the detailed structure near the nozzles in the line head of FIGS. 9A and 9B and showing the line head from the head chip side.

FIGS. 9A to 13 show the structure of the line head 120 for one color in the ink jet printer 100. FIG. 9A is a side view showing the appearance of the line head 120. FIG. 9B is a bottom view showing the appearance of the line head 120. FIG. 10 shows the detailed structure of the head chip 121. FIG. 11A is a side view showing the cross section along the line A—A in the line head 120 shown in FIG. 9B. FIG. 11B is a side view showing the cross section along the line B—B in the line head shown in FIG. 9B. FIG. 12 is a partial perspective view of the line head 120 shown in FIGS. 9A and 9B, as viewed from the bottom side. FIG. 13 is a partial perspective view of the line head 120 as viewed from the side of the head chip 121, in order to show the detailed structure near the nozzles in the line head 120 shown in FIGS. 9A and 9B.

The line head 120 is covered by an outer casing 126*b* constituting a later-described ink tank 126, and the lower part of the line head 120 is covered by a later-described electric wiring 127, as shown in FIG. 9A.

In the line head 120, a slit-shaped ink supply hole 122*a* is opened in a central portion of a linear head frame 122, as shown in FIG. 9B. A plurality of head chips 121 made of Si substrates are provided on one surface of the head frame 122. The head chips 121 are arrayed in a zigzag manner on both sides of the ink supply hole 122*a* opened in the head frame 122, in order to make the head long. Each of the head chips 121 is constituted by arranging the above-described plurality of heating elements 121*d* in a line on the side of the ink supply hole 122*a* and arranging connecting terminals 121*e* in a line corresponding to the heating elements 121*d*, on the side opposite to the ink supply hole 122*a*, that is, on the side of the outer casing 126*b*, as shown in FIGS. 9B and 10.

In the example of FIG. 10, the heating elements 121*a* are arrayed at 600 dpi (dots per inch). Moreover, in the head chip 121, the gate circuit 121*b* and the switching element 121*c* for the head chip 121 (heating elements 121*d*) to carry out time-division drive are provided between the heating elements 121*d* and the connecting terminals 121*e*.

Below the head chips 121 is a nozzle plate 124 having a plurality of nozzles 124*a*, with a member 123 provided between the head chips 121 and the nozzle plate 124, as shown in FIGS. 11A and 13. The member 123 is provided to form a plurality of liquid chambers 123*a* for storing ink and a plurality of flow paths 123*b* for causing the ink to flow to the liquid chambers 123*a*. The member 123 is made of a photosensitive resin such as a so-called dry film photoresist and is provided so that the heating elements 121*d* provided on the head chip 121 are correspondingly situated above the liquid chambers 123*a*, shown in detail in FIG. 13. Moreover, the member 123 is formed so that the flow paths 123*b* extend from the liquid chambers 123*a* to the end portions of the head chips 121, that is, to the end portions on the side of the central part of the line head 120, as shown in FIG. 11B.

The nozzle plate 124 is formed by electroforming nickel and is anticorrosive-plated with gold or palladium for preventing corrosion due to ink. The nozzle plate 124 is formed to close the ink supply hole 122*a*, which is a space formed by the head chip 121, the head frame 122, the member 123 and a later-described filter 125, as shown in FIGS. 11A, 11B and 12. Moreover, the nozzle plate 124 is formed so that the nozzles 124*a* correspond to the heating elements 121*d* one to one via the respective liquid chambers 123*a*, as shown in detail in FIG. 13. That is, each liquid chamber 123*a* is communicated with the flow path 123*b* formed in the member 123 and with the nozzle 124*a* formed in the nozzle plate 124.

On the other side of the head frame 122, the ink tank 126 is provided with a filter 125 arranged between the head frame 122 and the ink tank 126, as shown in FIGS. 11A and 11B. The filter 125 is provided to close the ink supply hole 122*a* and serves to prevent dust and flocculated ink ingredients from entering the nozzle 124*a* from the ink tank 126.

The ink tank 126 has a dual structure made up of a bag 126*a* and an outer casing 126*b*, as shown in FIG. 11B. A spring member 126*c* for energizing the bag 126*a* to expand outward is provided between the bag 126*a* and the outer casing 126*b*. Thus, in the line head 120, a negative pressure is applied on the ink in the ink tank 126 and spontaneous leakage of the ink from the nozzle 124*a* can be prevented. In the line head 120, since the negative pressure is set to be smaller than the capillary force of the nozzle 124*a*, the ink can be prevented from being drawn into the nozzle 124*a*.

Moreover, in the line head 120, an area including a part of the end surfaces of the head chips 121, the outer circumferential surface of the head frame 122 and the outer circumferential surface of the ink tank 126 is covered by the electric wiring 127 made of a so-called FPC (flexible printed board). The electric wiring 127 is provided for supplying electric power and electric signals to the head chips 121 and is connected to the connecting terminals 121*e* of the head chips 121.

In the ink jet printer 100 having the line head 120 as described above, ink is supplied from the ink tank 126 to the ink supply hole 122*a*, then passes through the flow paths 123*b*, and is supplied to the liquid chambers 123*a*. Each of the nozzles 124*a* has such a cross section that the circular distal end of a cone is cut off on a plane parallel to the bottom surface, as shown in FIG. 13, and a so-called meniscus of the ink surface with its central portion recessed by the negative pressure on the ink is formed at the distal end of the nozzle 124*a*. In the ink jet printer 100, when a driving voltage is supplied to the heating elements 121*d* and bubbles are generated on the surfaces of the heating elements 121*d*, ink particles are ejected from the nozzles 124*a*.

In the ink jet printer 100, since the head chips 121 are arranged in a zigzag manner as described above, the plurality of nozzles 124*a* (hereinafter referred to as nozzle group) corresponding to a single head chip 121 are similarly arranged in a zigzag manner.

Although there are conventional head chips arranged in a zigzag manner, these head chips are simply shifted from each other in parallel and therefore two adjacent nozzle groups $NG_A$, $NG_B$ are simply shifted from each other in parallel, as shown in FIG. 14. In the ink jet printer using this arrangement, unevenness in the quantity of ejection of ink among the head chips and errors of impact positions on the paper may take place because of unevenness in the characteristics of the head chips and positioning errors.

In the ink jet printer, if recording is made on the paper when there is unevenness in the quantity of ejection of ink, a change point (line) of the quantity of ejection, that is, of the diameter (print density) of dots, is generated in an area on the paper corresponding to the joint of the head chips. Specifically, if the ink jet printer uses head chips in which a nozzle group consisting of nozzles with a large quantity of ejection and a nozzle group consisting of nozzles with a small quantity of ejection are adjacent to each other, a change point (line) V of the diameter of dots is generated on the boundary between a dot group $DG_A$ recorded by the nozzle group consisting of the nozzles with a large quantity of ejection and a dot group $DG_B$ recorded by the nozzle group consisting of the nozzles with a small quantity ejection, as shown in FIG. 15A. Such a change point (line) of the dots causes a longitudinal stripe in the paper feed direction, that is, a so-called banding noise.

On the other hand, in the ink jet printer, if recording is made on the paper when there is an error of the impact position on the paper, an overlap of dots, a gap between dots, or a step between dots is generated in an area on the paper corresponding to the joint of the head chips. Specifically, an overlap O of dots as shown in FIG. 15B, a gap C between dots as shown in FIG. 15C, or a step L between dots as shown in FIG. 15D is generated on the boundary between a dot group $DG_A$ recorded by one nozzle group and a dot group $DG_B$ recorded by another nozzle group. These overlap of dots, gap between dots, and step between dots also cause a longitudinal stripe in the paper feed direction.

Figure 16:
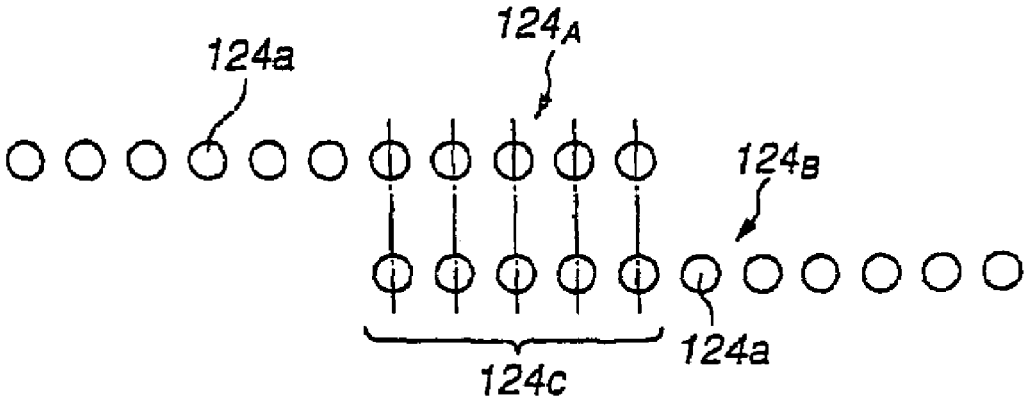
FIG. 16 shows the arrangement of two adjacent groups of nozzles in the line head shown in FIGS. 9A and 9B.

Thus, in the ink jet printer 100, an overlap part $\mathbf{124}_C$ is provided at the joint between a nozzle group $\mathbf{124}_A$ and a nozzle group $\mathbf{124}_B$ corresponding to the adjacent head chips 121, both nozzle groups consisting of a plurality of nozzles 124*a*, as shown in FIG. 16. That is, in the ink jet printer 100, of the nozzle groups corresponding to the adjacent head chips 121 arranged in a zigzag manner, a predetermined number of nozzles from right in the nozzle group $\mathbf{124}_A$ on the left side and the same number of nozzles from left in the nozzle group $\mathbf{124}_B$ on the right side are arranged so that their centerlines coincide with each other, and this portion of overlapping nozzles is provided as the overlap part $\mathbf{124}_C$.

Figure 17:
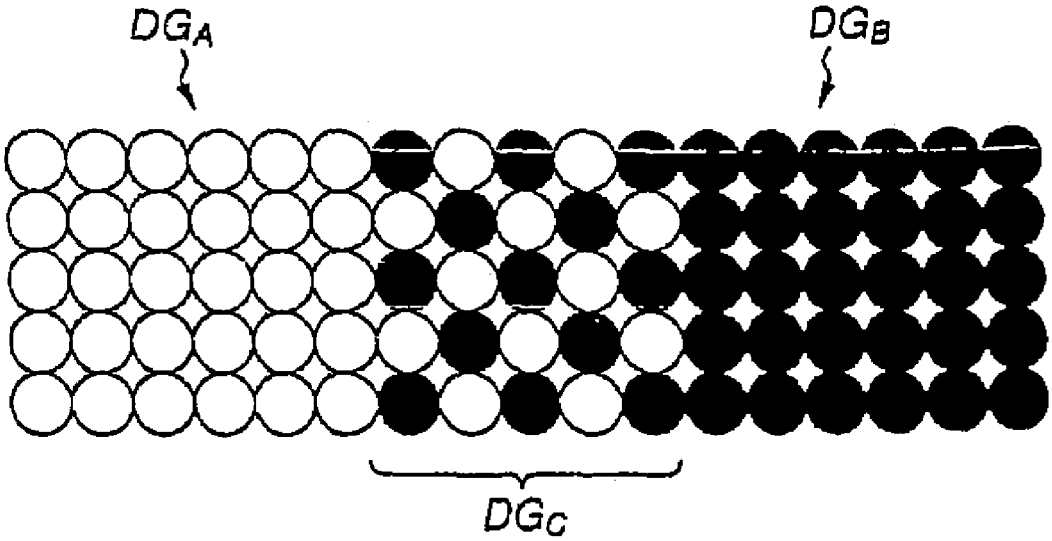
FIG. 17 shows the state of groups of dots recorded by using the line head shown in FIGS. 9A and 9B.

In the overlap part $\mathbf{124}_C$, the nozzles 124*a* constituting the one nozzle group $\mathbf{124}_A$ and the nozzles 124*a* constituting the other nozzle group $\mathbf{124}_B$ are used to alternately eject ink, for example, both in the lateral direction and in the longitudinal direction. Thus, a dot groups $DG_C$ corresponding to the overlap part $\mathbf{124}_C$ can be formed on the boundary between the dot group $DG_A$ recorded by the one nozzle group $\mathbf{124}_A$, indicated by white circles, and the dot groups $DG_B$ recorded by the other nozzle group $\mathbf{124}_B$, indicated by block circles, as shown in FIG. 17. In the dot group $DG_C$, the dots recorded by the nozzle group $\mathbf{124}_A$ and the dots recorded by the other nozzle group $\mathbf{124}_B$ are alternately arranged. Therefore, in the ink jet printer 100, the generation of the above-described longitudinal stripe, that is, the banding noise, can be reduced or moderated.

The PNM operation in the ink jet printer 100 will now be described in detail.

PNM is a technique for modulating the diameter of dots by the number of ink droplets continuously ejected in one pixel (pulse number), thus carrying out gray scale printing. This technique is advantageous in the case of digitally expressing the gray scale.

Figure 18:
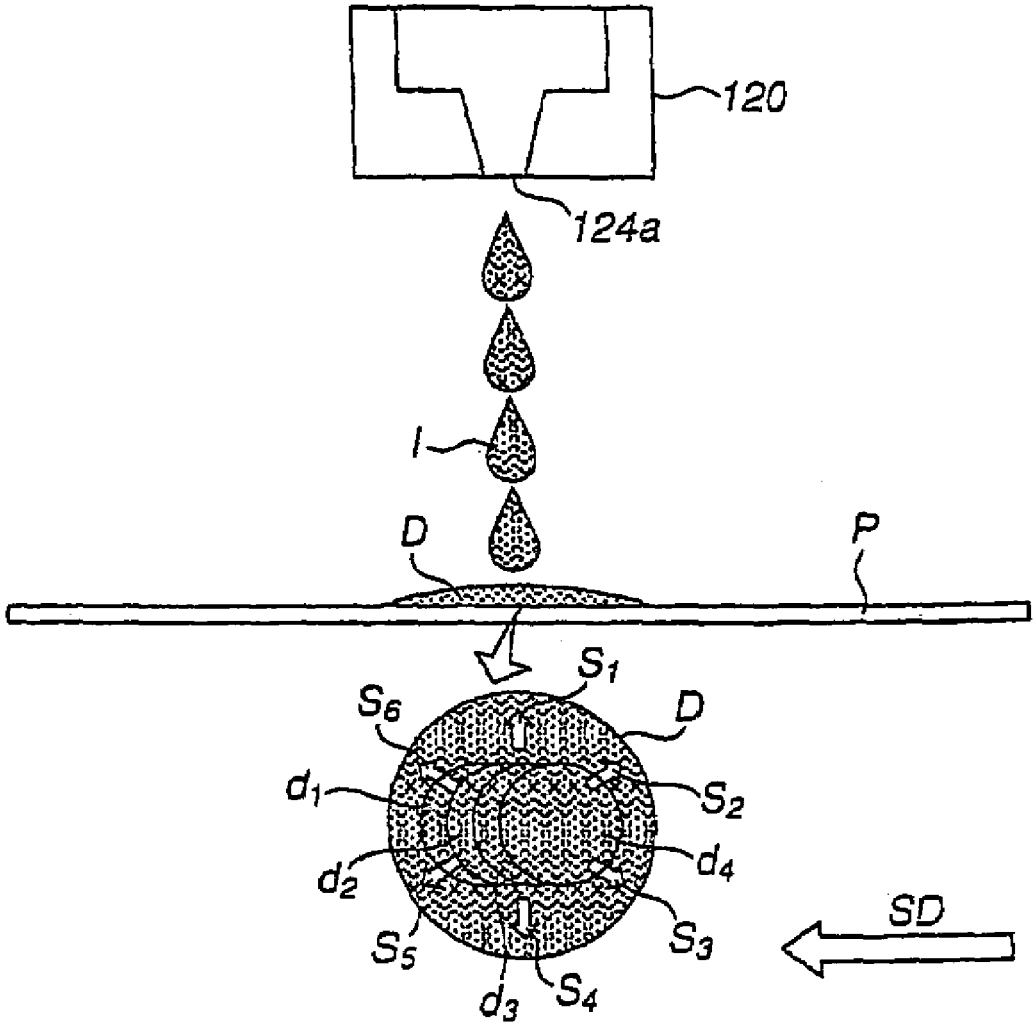
FIG. 18 is a conceptual view for explaining the principle of PNM.

FIG. 18 shows a conceptual view for explaining the principle of PNM.

In carrying out PNM, the ink jet printer 100 ejects one or a plurality of ink droplets I from the nozzles 124*a* onto paper P, thus recording a dot D thereon. When ejecting a plurality of ink droplets I, the ink jet printer 100 modulates the diameter of the dot D by impacting the next ink droplet I onto the paper P before the first ink droplet I impacted on the paper P is dried. That is, the ink jet printer 100 modulates the diameter of the dot D, utilizing the spread of dots d, formed by the respective ink droplets I impacted on the paper P correspondingly to each pulse, in all the directions of 360° as indicated by arrows $S_1$, $S_2$, $S_3$, $S_4$, $S_5$, $S_6$ in FIG. 18 before drying. In this example, the ink jet printer 100 impacts the next ink droplet I on the paper P before the first dot $d_1$ impacted on the paper P is dried, and thus recording dots $d_2$, $d_3$, $d_4$, . . . . In this case, the drying of the ink means that the spread of the ink does not exceed an allowable range. The ink jet printer 100 modulates the diameter of the dot D in the state where the plurality of ink droplets I spread in a united manner. In this case, since the paper P continuously moves in a direction indicated by an arrow SD in FIG. 18 relatively to the line head 120, the dots $d_1$, $d_2$, $d_3$, $d_4$, . . . recorded on the paper P are slightly shifted in the opposite direction of the feed direction of the paper P.

If the impacting period of the ink droplet I onto the paper P is shorter than a predetermined period, the ink isotropically spreads and therefore the dot D presents a shape similar to a true circle. If the impacting period of the ink droplet I onto the paper P is longer, the dot D presents a substantially elliptic shape which is long in the feed direction of the paper P. The relation between the impacting period of the ink droplet I onto the paper P and the aspect ratio of the diameter of the dot D changes, depending on the properties of the ink and the paper P such as the absorption of the ink to the paper P. The ink jet printer 100 determines the impacting period of the ink droplet I onto the paper P on the basis of experimental values and in accordance with desired use conditions, for example, to expand the period for sufficiently increasing the diameter of the dot D. The ink jet printer 100 employs, for example, approximately 100 milliseconds or less as the impacting period of the ink droplet I onto the paper P.

The line head 120 in the ink jet printer 100 has four colors such as CMYK as described above. When mixing ink droplets of a plurality of colors, the ink jet printer 100 impacts an ink droplet of one color on the paper P and then impacts the next ink droplet of a different color after the first impacted and recorded dot is dried. If the time until impacting the next ink droplet of the different color is short, the spread of the ink called color bleed occurs, causing deterioration of the picture quality. In this case, the ink jet printer 100 preferably impacts an ink droplet of black (K) on the paper P lastly. This is because the black ink usually does not dry fast. The ink jet printer 100 can provide a sharp recorded image by lastly impacting the black ink on the paper P. Moreover, the ink jet printer 100 can provide a more natural image by first impacting a yellow (Y) ink, which is bright in contrast to the black ink, on the paper P.

An ordinary serial head, which does not carry out the one-path recording, can increase the number of gray scales by overprinting a plurality of times at the same position in scanning back and forth on the paper, but has a problem of a long recording time corresponding to the number of times of overprinting. On the other hand, a line head can complete recording by scanning once and therefore can reduce the recording time remarkably. If recording is carried out using the line head with a resolution of 600 dpi and a pixel (line) recording frequency of 10 kHz, the time required for scanning the longitudinal direction of paper of A4 size is approximately 0.7 second per color in the case where one ink droplet is ejected.

However, in consideration of the ink drying time, a recording time of approximately 10 seconds is considered appropriate with the line head. In this case, the pixel (line) recording frequencies for resolutions of 300 dpi, 600 dpi, and 1200 dpi are approximately 350 Hz, 700 Hz, and 1.4 kHz, respectively. Therefore, an ink jet printer using a line head can carry out PNM within the pixel (line) recording frequency, unlike an ink jet printer using an ordinary serial head. Thus, PNM is considered as a gray scale expressing method suitable for the line head.

The quality of a recorded image printed by the ink jet printer 100 using PNM will now be described.

To improve the picture quality, the resolution of the recorded image should be raised for printing. However, it is desired to minimize the number of nozzles in view of the manufacturing cost and reliability, thus raising a problem of designing that the resolution of the recorded image cannot be raised.

Thus, by using PNM for printing, the ink jet printer 100 can express gray scales within a pixel and can provide a recorded image of high definition with less rough or granular appearance even when a lower resolution is set than in binary recording. Moreover, the ink jet printer 100 supplements the number of gray scales based on PNM determined by the maximum pulse number in forming one dot and therefore can combine PNM with so-called dot density modulation. In this case, since multi-level recording within a pixel can be realized by using PNM, the ink jet printer 100 can carry out not only binary but also multi-level dither processing and error diffusion processing, and can carry out smoother gray scale printing of high definition.

The measures to cope with an error in the impact position on the paper and unevenness in the quantity of ejection of ink among the nozzles in the ink jet printer 100 using PNM will now be described. In the following description, the ink jet printer 100 of design specifications shown in Table 1 is used.

TABLE 1

| | |
|---|---|
| Maximum recording width | 8.5 inches |
| Resolution | 600 dpi |
| Number of nozzles per color | 5100 |
| Target quantity of ejection of each nozzle per pulse | 3 pl |

TABLE 1-continued

| | |
|---|---|
| Maximum pulse number | 8 pulses |
| Number of levels | 9 levels |
| Ejection frequency | 4.8 kHz |
| Line recording frequency | 600 Hz |

With these design specifications, the ink jet printer 100 ejects ink droplets for 8 pulses at the maximum to pixels of 600 dpi. One pulse is equivalent to ink droplets for 3 pl and ink droplets for 24 pl at the maximum are ejected for one pixel. The diameter of a dot in this case is approximately 40 μm for one pulse on ink jet glossy paper on the market, used for evaluation. The ideal dot diameter is $\sqrt{2}$ times the obtained value, that is, approximately 60 μm. The ink jet printer 100 assumes a position for forming one dot by one ink droplet on the paper as a virtual lattice point on the paper, and ideally, the ink jet printer 100 forms dots at and around the lattice points. The ink jet printer 100 provides a dot deviation margin of 20 μm on the paper as an allowable range of deviation of dots from the lattice points. With this margin, the ink jet printer 100 copes with the problem of an error of the impact position on the paper.

To provide a recorded image of high definition, the unevenness in the characteristics of the nozzles must be minimized. As a method for reducing the unevenness in the quantity of ejection among the nozzles, that is, the unevenness in the print density, it is considered to change the electric power applied to heating element and the pulse width, for each nozzle.

Figure 19:
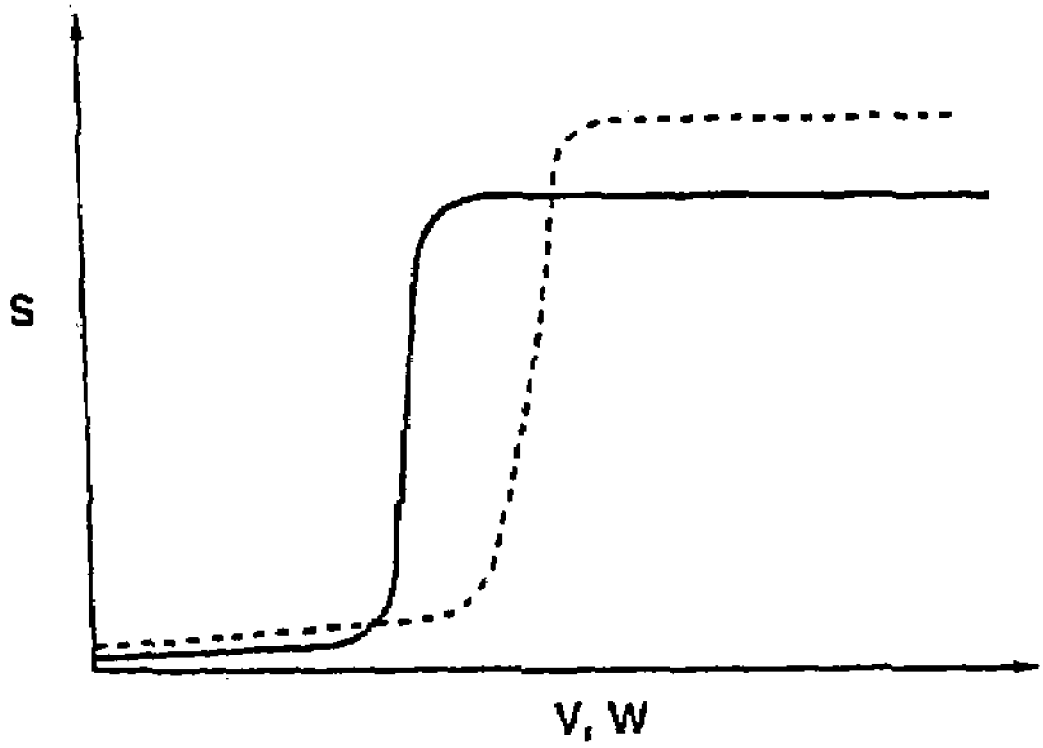
FIG. 19 shows the relation between the quantity of ink droplets ejected from the nozzles and the power applied to the heating elements or the pulse duration.

However, the quantity of ejection S of ink droplets from the nozzles usually does not monotonously increase along with the increase in the power V applied to the heating elements, but tends to suddenly increase when the power exceeds a predetermined power value, as indicated by a solid line in FIG. 19. The quantity of ejection S of ink droplets in relation to the pulse width W usually presents the same tendency, as indicated by a broken line in FIG. 19. That is, in the ink jet printer, it is difficult to control the quantity of ejection of ink droplets by the power applied to the heating elements and the pulse width.

Thus, the ink jet printer 100 carries out correction of unevenness in the print density, using PNM. Specifically, when producing a recorded image having predetermined gray scales by using a plurality of nozzles with different quantities of ejection, the ink jet printer 100 changes the pulse number by using PNM, thus controlling the quantity of ejection of ink droplets from the nozzles and correcting the unevenness in the quantity of ejection among the nozzles.

For example, a nozzle which ejects 3 pl of ink droplets, the target quantity of ejection for each nozzle per pulse, and a nozzle which can only eject 2.5 pl of ink droplets per pulse, are considered. Since ink droplets for 8 pulses at the maximum are used for recording one pixel, the quantity of ejection should be 3 pl, 6 pl, 9 pl, 12 pl, 15 pl, 18 pl, 21 pl and 24 pl, respectively, for eight levels. However, with the nozzle having the quantity of ejection of 2.5 pl per pulse, only 2.5 pl, 5 pl, 7.5 pl, 10 pl, 12.5 pl, 15 pl, 17.5 pl and 20 pl of ink droplets are ejected, respectively. Therefore, the difference in the quantity of ejection is −0.5 pl, −1 pl, −1.5 pl, −2 pl, −2.5 pl, −3 pl, −3.5 pl and −4 pl for the respective levels.

When ink droplets are to be ejected from the nozzle having the quantity of ejection of 2.5 pl per pulse, the quantity of ejection is caused to be 2.5 pl, 5 pl, 10 pl, 12.5 pl, 15 pl, 17.5 pl, 20 pl and 25 pl by generating 1 pulse, 2 pulses, 4 pulses, 5 pulses, 6 pulses, 7 pulses, 8 pulses and 10 pulses. Therefore, the difference in the quantity of ejection between the nozzle of 2.5 pl per pulse and the nozzle of 3 pl per pulse is −0.5 pl, −1 pl, +1 pl, +0.5 pl, 0 pl, −0.5 pl, −1 pl and +1 pl. The difference in the quantity of ejection can be restrained to 1 pl at the maximum.

Meanwhile, a nozzle with the quantity of ejection of 3.5 pl per pulse is considered. The quantity of ejection 3.5 pl, 7 pl, 10.5 pl, 14 pl, 17.5 pl, 21 pl, 24.5 pl and 28 pl, respectively, for eight levels. Therefore, the difference in the quantity of ejection between this nozzle and the nozzle of 3 pl per pulse is +0.5 pl, +1 pl, +1.5 pl, +2 pl, +2.5 pl, +3 pl, +3.5 pl and +4 pl for the respective levels.

When ink droplets are to be ejected form the nozzle having the quantity of ejection of 3.5 pl per pulse, the quantity of ejection is caused to be 3.5 pl, 7 pl, 10.5 pl, 10.5 pl, 14 pl, 17.5 pl, 21 pl and 24.5 pl by generating 1 pulse, 2 pulses, 3 pulses, 3 pulses, 4 pulses, 5 pulses, 6 pulses and 7 pulses. Therefore, the difference in the quantity of ejection between this nozzle and the nozzle of 3 pl per pulse is +0.5 pl, +1 pl, +1.5 pl, −1.5 pl, −1 pl, −0.5 pl, 0 pl and +0.5 pl for the respective levels. The difference in the quantity of ejection can be restrained to 1.5 pl at the maximum.

In this manner, when producing a recorded image having predetermined gray scales by using a plurality of nozzles with different quantities of ejection, the ink jet printer 100 changes the number of ink droplets to be ejected from each nozzle and corrects the unevenness in the quantity of ejection among the nozzles. Thus, the ink jet printer 100 can control the quantity of ejection of ink droplets from the nozzles and can restrain the difference in the quantity of ejection per pixel.

Figure 20A:
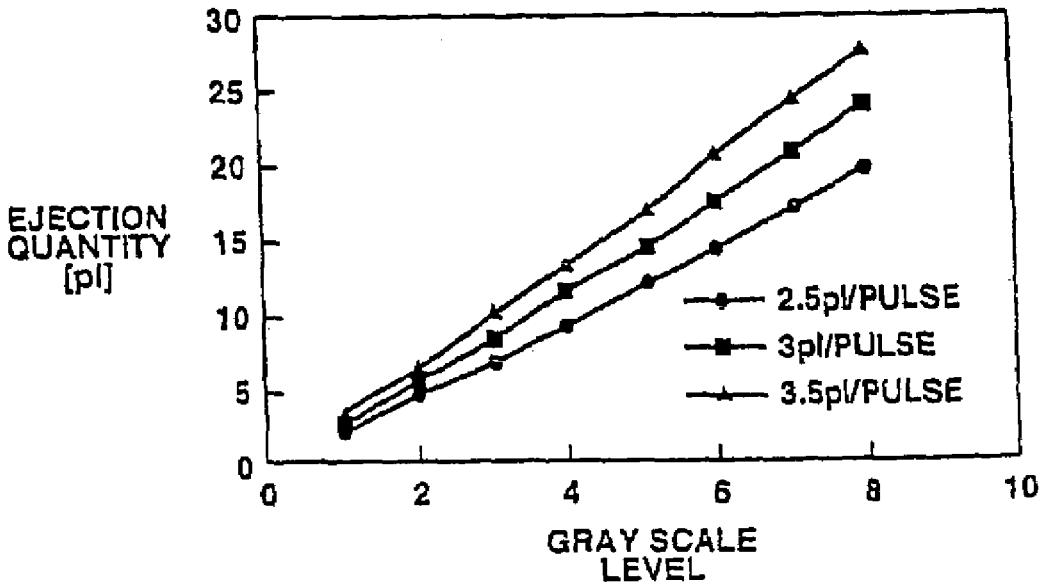
FIG. 20A shows the relation between the gray scale level and the quantity of ejection before the pulse number is corrected in accordance with the quantity of ejection from the nozzles.
Figure 20B:
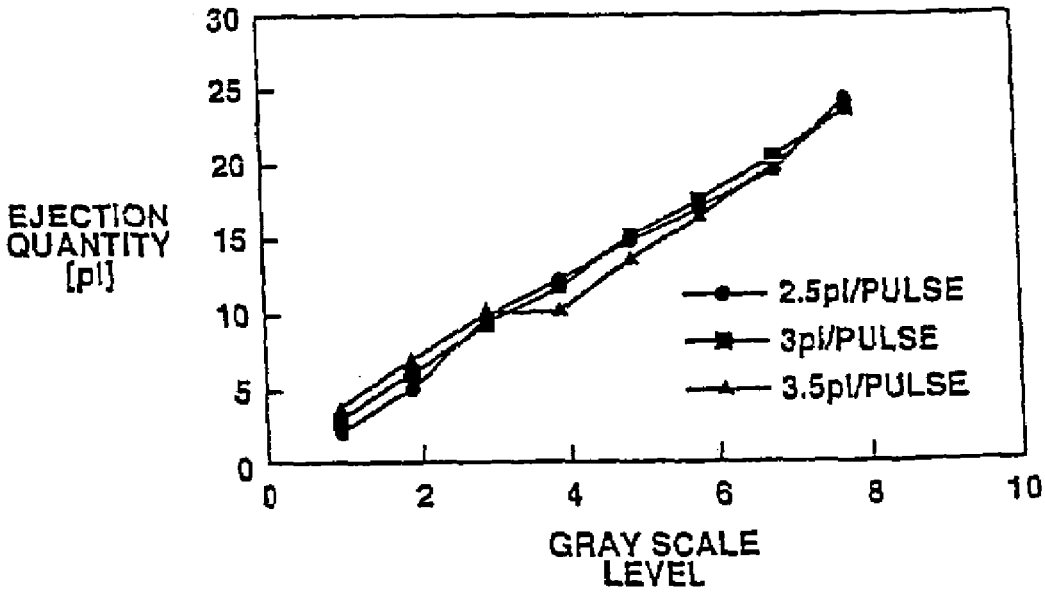
FIG. 20B shows the relation between the gray scale level and the quantity of ejection after the pulse number is corrected in accordance with the quantity of ejection from the nozzles.

FIG. 20A shows the relation between the gray scale level and the quantity of ejection before the pulse number is corrected in accordance with the quantity of ejection from the nozzles. FIG. 20B shows the relation between the gray scale level and the quantity of ejection after the pulse number is corrected in accordance with the quantity of ejection from the nozzles. As can be seen from FIGS. 19A and 19B, if the pulse number is not corrected in accordance with the quantity of ejection from the nozzles, the quantity of ejection necessary for expressing the same gray scale level differs among the nozzles. On the other hand, if the pulse number is corrected in accordance with the quantity of ejection from the nozzles, the quantity of ejection necessary for expressing the same gray scale level is substantially the same among the respective nozzles.

Figure 21:
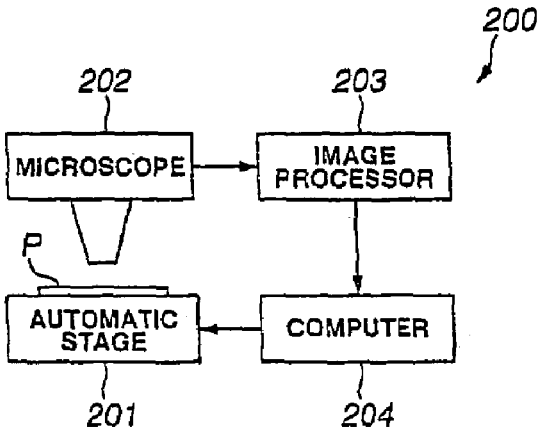
FIG. 21 is a block diagram showing the structure of an automatic measuring device for measuring the diameter of a dot.

An ejection test is carried out for all the nozzles and the quantity of ejection from each nozzle is measured on the basis of the diameter of each dot recorded on the paper. The relation between the quantity of ejection and the diameter of the dot is found in a measurement graph, which is prepared separately. The diameter of the dot is measured by an automatic measuring device 200 having at least a microscope 202 and an image processor 203, as shown in FIG. 21.

Specifically, in the automatic measuring device 200, a dot recorded on the paper P on an automatic stage 201 is read by the image processor 203 using the microscope 202, and the quantity of ejection is calculated by a computer 204 on the basis of the diameter of the dot. The automatic measuring device 200 carries out such an operation for all the nozzles and prepares a correction table relating to the pulse number corresponding to each nozzle.

In the ink jet printer 100, the correction table thus prepared is stored in the correcting circuit 162 as the correction data. At the time of recording, the ink jet printer 100 determines the pulse number for each nozzle on the basis of the correction data and controls the quantity of ejection of ink droplets so as to carry out recording.

The pulse number thus corrected sometimes exceeds 8, which is presented as the standard maximum pulse number in Table 1. Therefore, the ink jet printer 100 needs to preset a slightly large value for the maximum pulse number for recording, and determines the maximum pulse number in accordance with the unevenness in the quantity of ejection. If the unevenness is within the range of 3±0.5 pl as in the above-described example, since the minium quantity of ejection is 2.5 pl, the maximum pulse number may be 10. In this case, the ejection frequency must be 6 kHz (or higher) to meet the line recording frequency of 600 Hz.

In this manner, when producing a recorded image having predetermined gray scales by using a plurality of nozzles with different quantities of ejection, the ink jet printer 100 changes the pulse number by using PNM. Thus, the ink jet printer 100 can control the quantity of ejection of ink droplets from the nozzles and can correct the unevenness in the quantity of ejection among the nozzles. By thus correcting the unevenness in the print density, the ink jet printer 100 can provide a smoother recorded image of high definition.

The method for ejecting ink droplets by the ink jet printer 100 will now be described.

Figure 22:
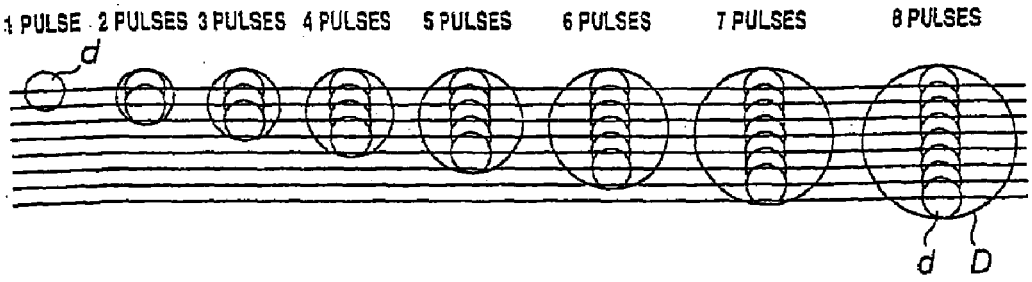
FIG. 22 shows the state of dots formed in the case where the pulse number is increased with reference to a given time point irrespective of the recording direction in performing PNM.

In the ink jet printer, the paper moves relatively to the line head as described above. Therefore, in carrying out PNM, when the pulse number is increased from a reference time point as shown in FIG. 22, the tendency becomes noticeable such that the center of a dot D, formed by dots d based on respective ink droplets on the paper correspondingly to each pulse, shifts rearward with respect to the paper feed direction.

Figure 23A:
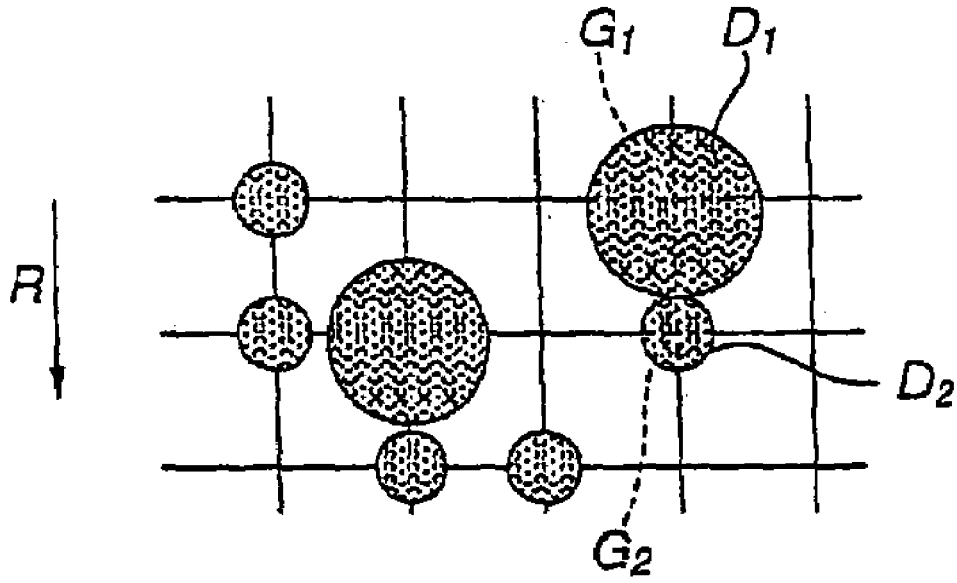
FIG. 23A shows the state of each dot to be recorded on paper, in which each dot is recorded so that the center of each dot is located at a lattice point.

For example, it is assumed that recording should be carried out so that the centers of dots are situated on respective lattice points on the paper, as shown in FIG. 23A. In FIG. 23A, a dot $D_1$ with a large diameter and a dot $D_2$ with a small diameter are shown. Since these dots $D_1$, $D_2$ are recorded on predetermined lattice points $G_1$, $G_2$ where these dots should be recorded, the dots $D_1$, $D_2$ dot not overlap each other.

Figure 23B:
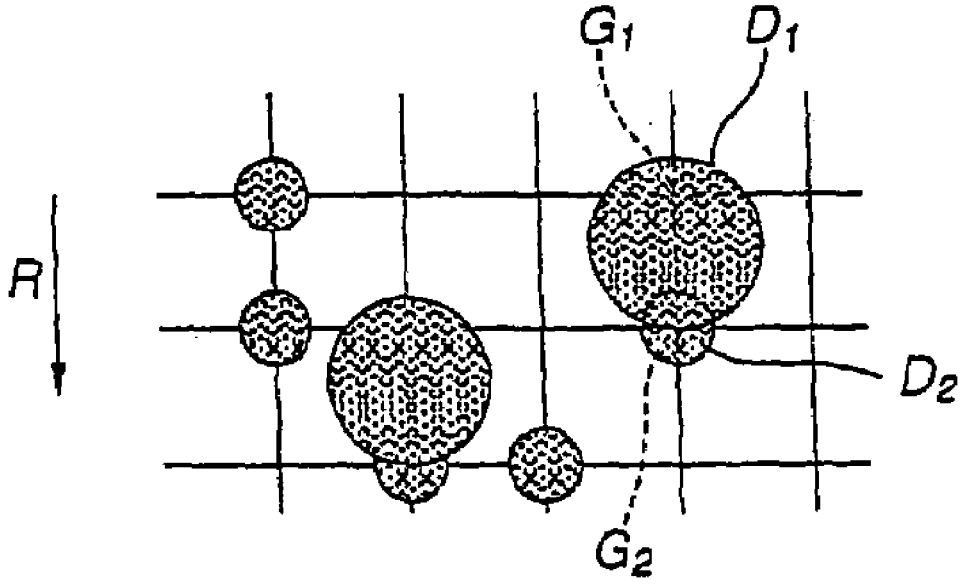
FIG. 23B shows the state of each dot to be recorded on paper, in which a dot with a large diameter is recorded so that the center of the dot with a large diameter is not located at a predetermined lattice point for recording.

However, in carrying out PNM, if the pulse number is increased from a reference time point without considering the recording direction (opposite of the paper feed direction) indicated by an arrow R in FIG. 23A, the center of the dot $D_1$ with a large diameter is not recorded on the predetermined lattice point $G_1$ where it should be recorded, as shown in FIG. 23B. That is, the dot $D_1$ is shifted in the direction of the arrow R in FIG. 22B. As a result, the dot $D_1$ is recorded, overlapping the next recorded dot $D_2$.

As described above, in carrying out PNM in the ink jet printer, if the pulse number is increased from a reference time point without considering the recording direction, the center of a dot with a large diameter is shifted from the lattice point where the dot should be formed, and this causes failure in recording such that a straight line to be recorded is actually recorded as a curved line. Therefore, accurate recording cannot be carried out.

Thus, in order to avoid such a problem in carrying out PNM, the ink jet printer 100 distributes ink droplets in the paper feed direction from the lattice point as the center, thus carrying out recording.

Figure 24:
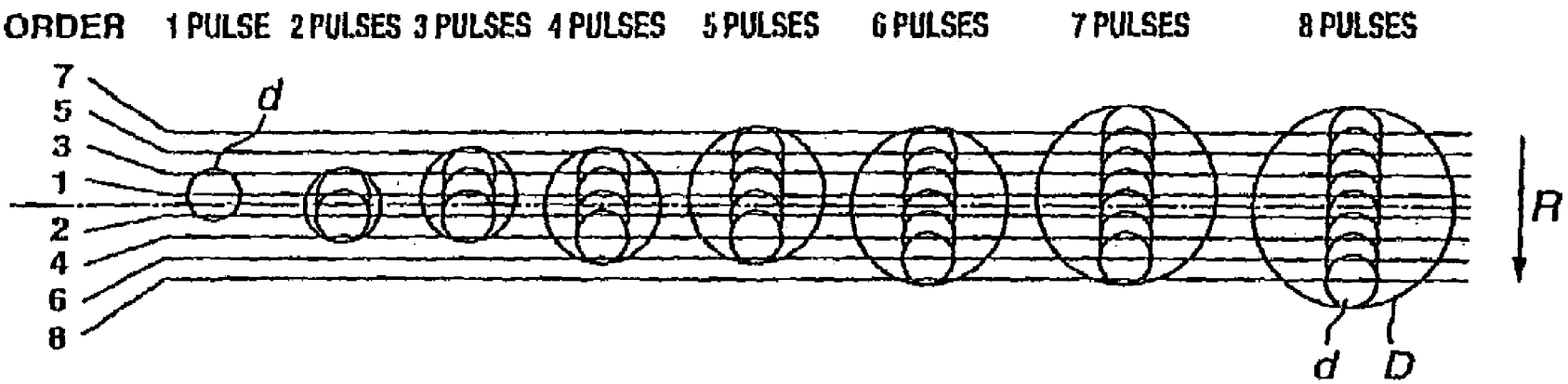
FIG. 24 shows the state of a dot formed in the case where recording is carried out by generating a pulse to be an object of comparison with the record data from the comparator so that the resultant dot is equivalent to a dot formed by distributing ink droplets in the paper feed direction symmetrically about a lattice point as the center in performing PNM, and shows the case where a dot having an ultimate diameter is formed with ink droplets of even ordinal numbers.

For example, when forming a dot D having an ultimate diameter with ink droplets of even ordinal numbers, as shown in FIG. 24, the ink jet printer 100 causes the pulse generator 163*b* to generate a pulse to be an object of comparison with the record data from the comparators 163*c* in accordance with the order described in the left end part of FIG. 24, so that the resultant dot is equivalent to a dot formed by distributing ink droplets of odd ordinal numbers and ink droplets of even ordinal numbers in the paper feed direction symmetrically about a lattice point as the center indicated by a chain-dotted line in FIG. 24, in which an arrow R represents the recording direction (reverse of the paper feed direction).

Figure 25A:
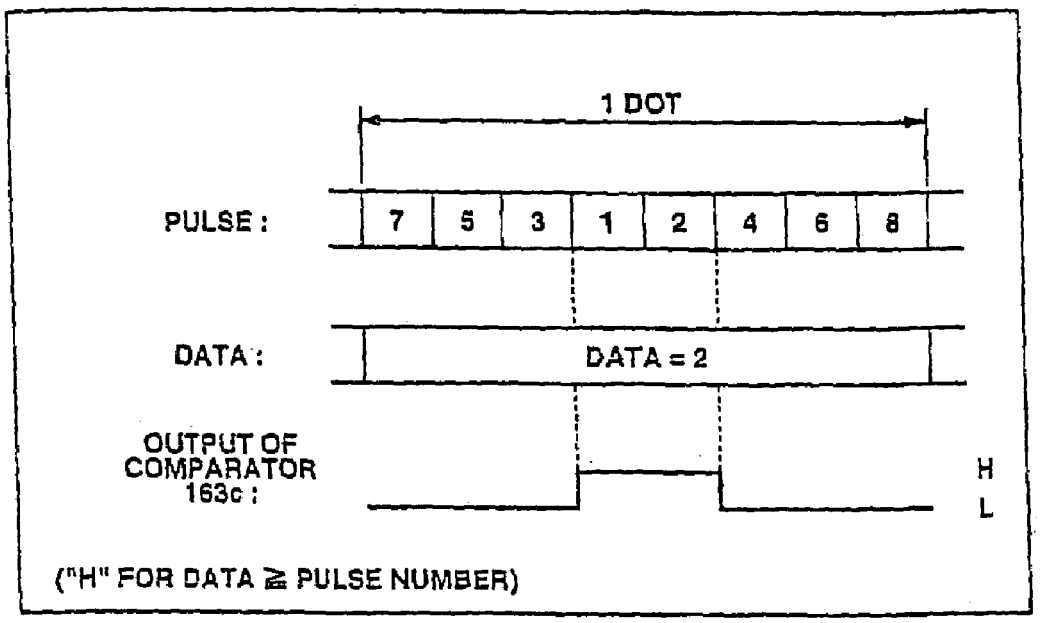
FIG. 25A illustrates a specific example of recording by the method shown in FIG. 24, and shows the relation between a pulse generated by the pulse generator provided in the head drive circuit, record data stored in the memory provided in the head drive circuit, and a signal outputted from the comparator provided in the head drive circuit, in the case where data with respect to the heating elements has a value "2."

Specifically, in the ink jet printer 100, if data for a certain heating element is "2," the comparators 163*c* generate a low signal "L" as phase-corresponding data d with respect to pulse numbers "7, 5, 3" generated by the pulse generator 163*b*, then generate a high signal "H" as phase-corresponding data d only when the pulse number is "1, 2," and generate a low signal "L" as phase-corresponding data d with respect to pulse numbers "4, 6, 8," as shown in FIG. 25A. Therefore, in the ink jet printer 100, during the periods when the pulse number is "7, 5, 3, 4, 6, 8" and the comparators 163*c* generate a low signal "L" as phase-corresponding data d, the paper is carried without driving the heating element, and only during the periods when the pulse number is "1, 2" and the comparators 163 generate a high signal "H," the target heating element is driven to eject ink droplets from the nozzle. By doing so, the ink jet printer 100 can form a dot equivalent to a dot shown in FIG. 24 as a dot in the case where the pulse number is "2."

Figure 25B:
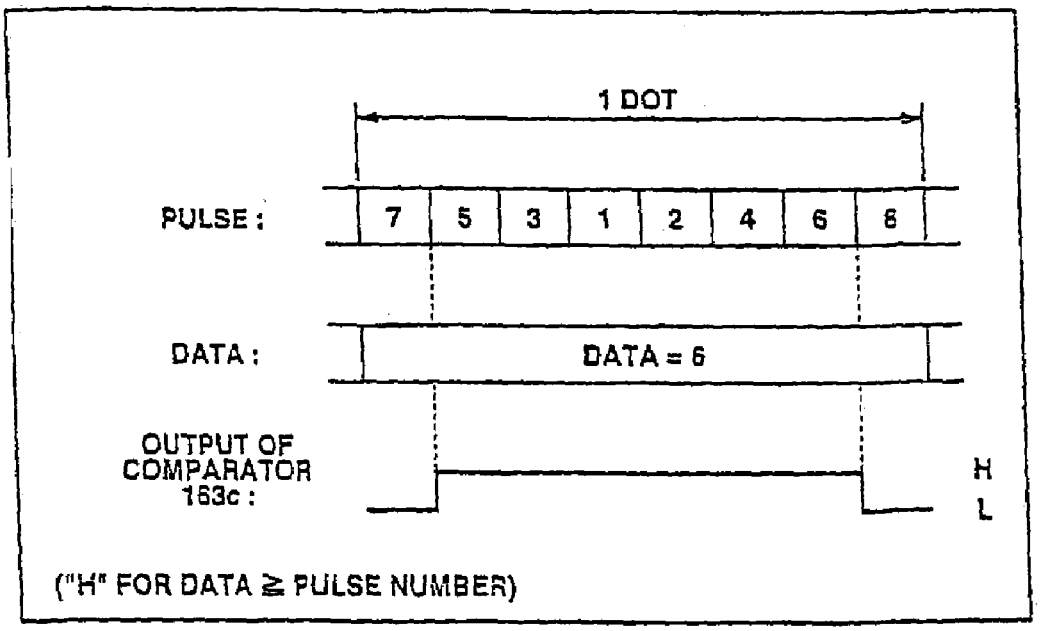
FIG. 25B illustrates a specific example of recording by the method shown in FIG. 24, and shows the relation between a pulse generated by the pulse generator provided in the head drive circuit, record data stored in the memory provided in the head drive circuit, and a signal outputted from the comparator provided in the head drive circuit, in the case where data with respect to the heating elements has a value "6."

Similarly, in the ink jet printer 100, if data for a certain heating element is "6," the comparators 163*c* generate a low signal "L" as phase-corresponding data d with respect to a pulse number "7" generated by the pulse generator 163*b*, then generate a high signal "H" as phase-corresponding data d only when the pulse number is "5, 3, 1, 2, 4, 6" and generate a low signal "L" as phase-corresponding data d with respect to a pulse number "8," as shown in FIG. 25B. Therefore, in the ink jet printer 100, during the periods when the pulse number is "7, 8" and the comparators 163*c* generate a low signal "L" as phase-corresponding data d, the paper is carried without driving the heating element, and only during the periods when the pulse number is "5, 3, 1, 2, 4, 6" and the comparators 163 generate a high signal "H," the target heating element is driven to eject ink droplets from the nozzle. By doing so, the ink jet printer 100 can form a dot equivalent to a dot shown in FIG. 24 as a dot in the case where the pulse number is "6."

Figure 26:
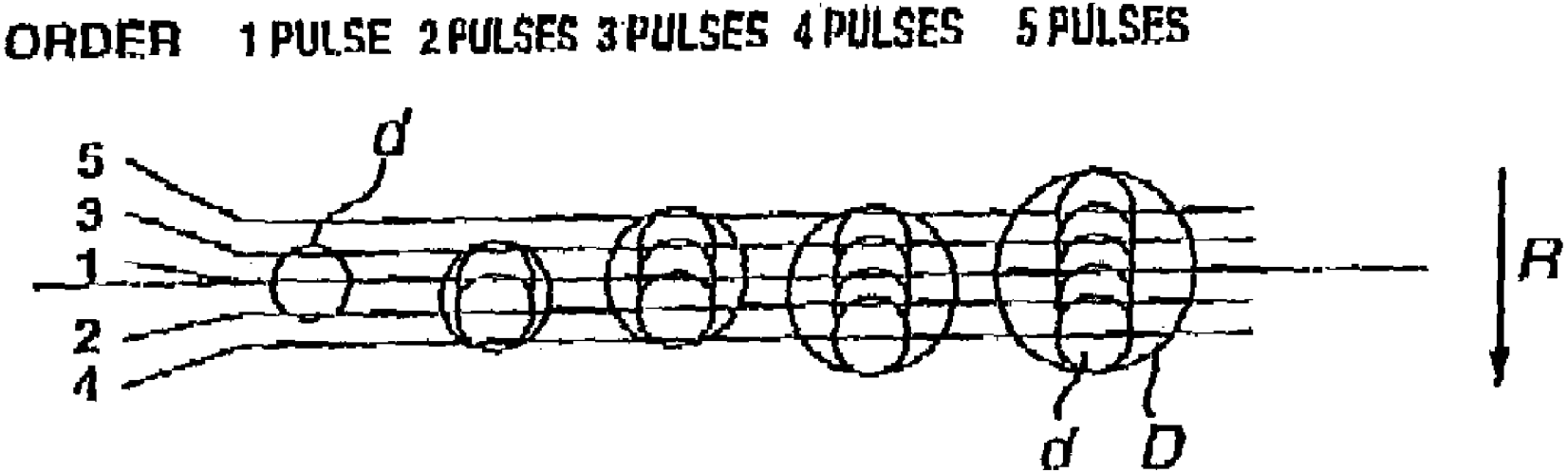
FIG. 26 shows the state of a dot formed in the case where recording is carried out by generating a pulse to be an object of comparison with the record data from the comparator so that the resultant dot is equivalent to a dot formed by distributing ink droplets in the paper feed direction symmetrically about a lattice point as the center in performing PNM, and shows the case where a dot having an ultimate diameter is formed with ink droplets of odd ordinal numbers.

On the other hand, when forming a dot D having an ultimate diameter with ink droplets of odd ordinal numbers, as shown in FIG. 26, in which an arrow R represents the recording direction (reverse of the paper feed direction), the ink jet printer 100 causes the pulse generator 163*b* to generate a pulse to be an object of comparison with the record data from the comparators 163*c* in accordance with the order described in the left end part of FIG. 26, so that the resultant dot is equivalent to a dot formed by impacting the first ink droplet on a lattice point indicated by a chain-dotted line in FIG. 26 and then distributing ink droplets of odd ordinal numbers and ink droplets of even ordinal numbers in the paper feed direction symmetrically about the lattice point as the center.

Figure 27A:
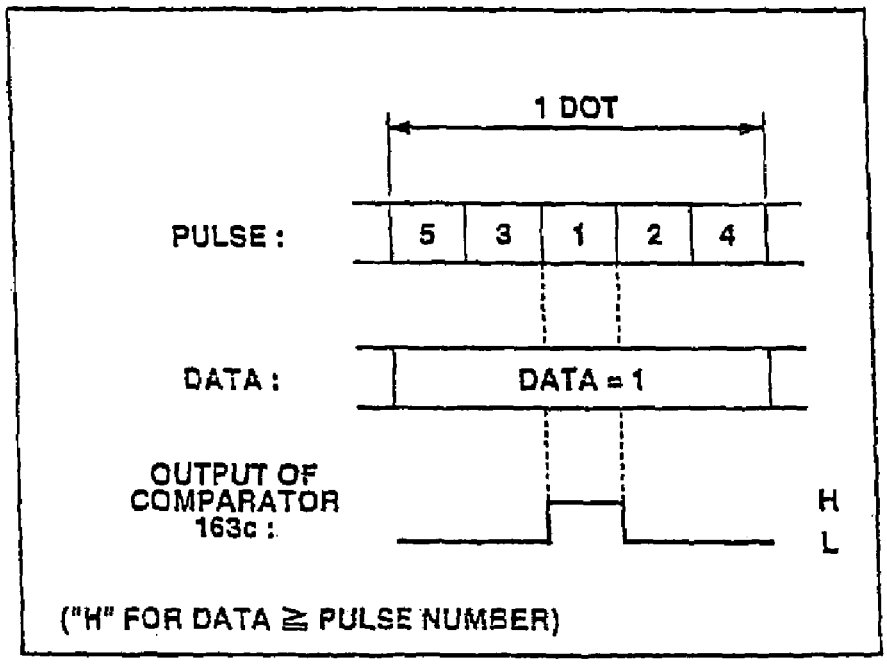
FIG. 27A illustrates a specific example of recording by the method shown in FIG. 26, and shows the relation between a pulse generated by the pulse generator provided in the head drive circuit, record data stored in the memory provided in the head drive circuit, and a signal outputted from the comparator provided in the head drive circuit, in the case where data with respect to the heating elements has a value "1."

Specifically, in the ink jet printer 100, if data for a certain heating element is "1," the comparators 163*c* generate a low signal "L" as phase-corresponding data d with respect to pulse numbers "5, 3" generated by the pulse generator 163*b*, then generate a high signal "H" as phase-corresponding data d only when the pulse number is "1," and generate a low signal "L" as phase-corresponding data d with respect to pulse numbers "2, 4," as shown in FIG. 27A. Therefore, in the ink jet printer 100, during the periods when the pulse number is "5, 3, 2, 4" and the comparators 163*c* generate a low signal "L" as phase-corresponding data d, the paper is carried without driving the heating element, and only during the periods when the pulse number is "1" and the comparators 163 generate a high signal "H," the target heating element is driven to eject ink droplets from the nozzle. By doing so, the ink jet printer 100 can form a dot equivalent to a dot shown in FIG. 26 as a dot in the case where the pulse number is "1."

Figure 27B:
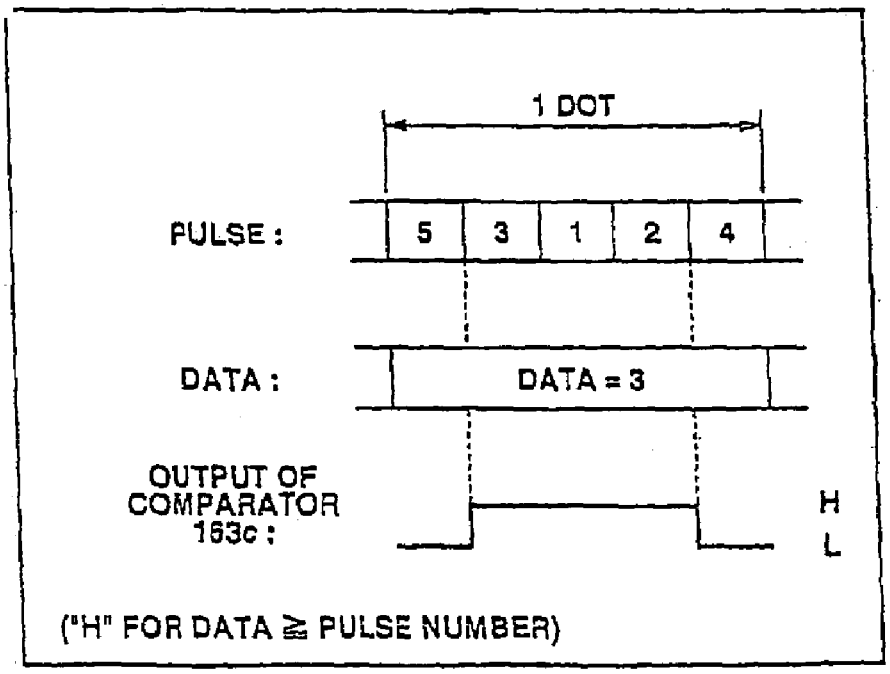
FIG. 27B illustrates a specific example of recording by the method shown in FIG. 26, and shows the relation between a pulse generated by the pulse generator provided in the head drive circuit, record data stored in the memory provided in the head drive circuit, and a signal outputted from the comparator provided in the head drive circuit, in the case where data with respect to the heating elements has a value "3."

Similarly, in the ink jet printer 100, if data for a certain heating element is "3," the comparators 163*c* generate a low signal "L" as phase-corresponding data d with respect to a pulse number "5" generated by the pulse generator 163*b*, then generate a high signal "H" as phase-corresponding data d only when the pulse number is "3, 1, 2," and generate a low signal "L" as phase-corresponding data d with respect to a pulse number "4," as shown in FIG. 27B. Therefore, in the ink jet printer 100, during the periods when the pulse number is "5, 4" and the comparators 163*c* generate a low signal "L" as phase-corresponding data d, the paper is carried without driving the heating element, and only during the periods when the pulse number is "3, 1, 2" and the comparators 163 generate a high signal "H," the target heating element is driven to eject ink droplets from the nozzle. By doing so, the ink jet printer 100 can form a dot equivalent to a dot shown in FIG. 26 as a dot in the case where the pulse number is "3."

In this manner, the ink jet printer 100 carries out recording while changing the ink droplet impact position on the paper in accordance with the pulse number so as to form a dot equivalent to a dot formed in the case where ink droplets are distributed in the paper feed direction from the lattice point as the center. In this case, when forming a dot D with ink droplets of even ordinal numbers, the ink jet printer 100 determines the order of pulses to be generated so that the resultant dot is equivalent to a dot formed by distributing ink droplets of odd ordinal numbers and ink droplets of even ordinal numbers in the paper feed direction symmetrically about the lattice point as the center. When forming a dot D with ink droplets of odd ordinal numbers, the ink jet printer 100 determines the order of pulses to be generated so that the resultant dot is equivalent to a dot formed by impacting the first ink droplet on the lattice point and then distributing ink droplets of odd ordinal numbers and ink droplets of even ordinal numbers in the paper feed direction symmetrically about the lattice point as the center. Thus, the ink jet printer 100 can minimize the deviation of the formed dot from the lattice point and can prevent curving of a straight line and unwanted overlapping of dots.

Figure 28:
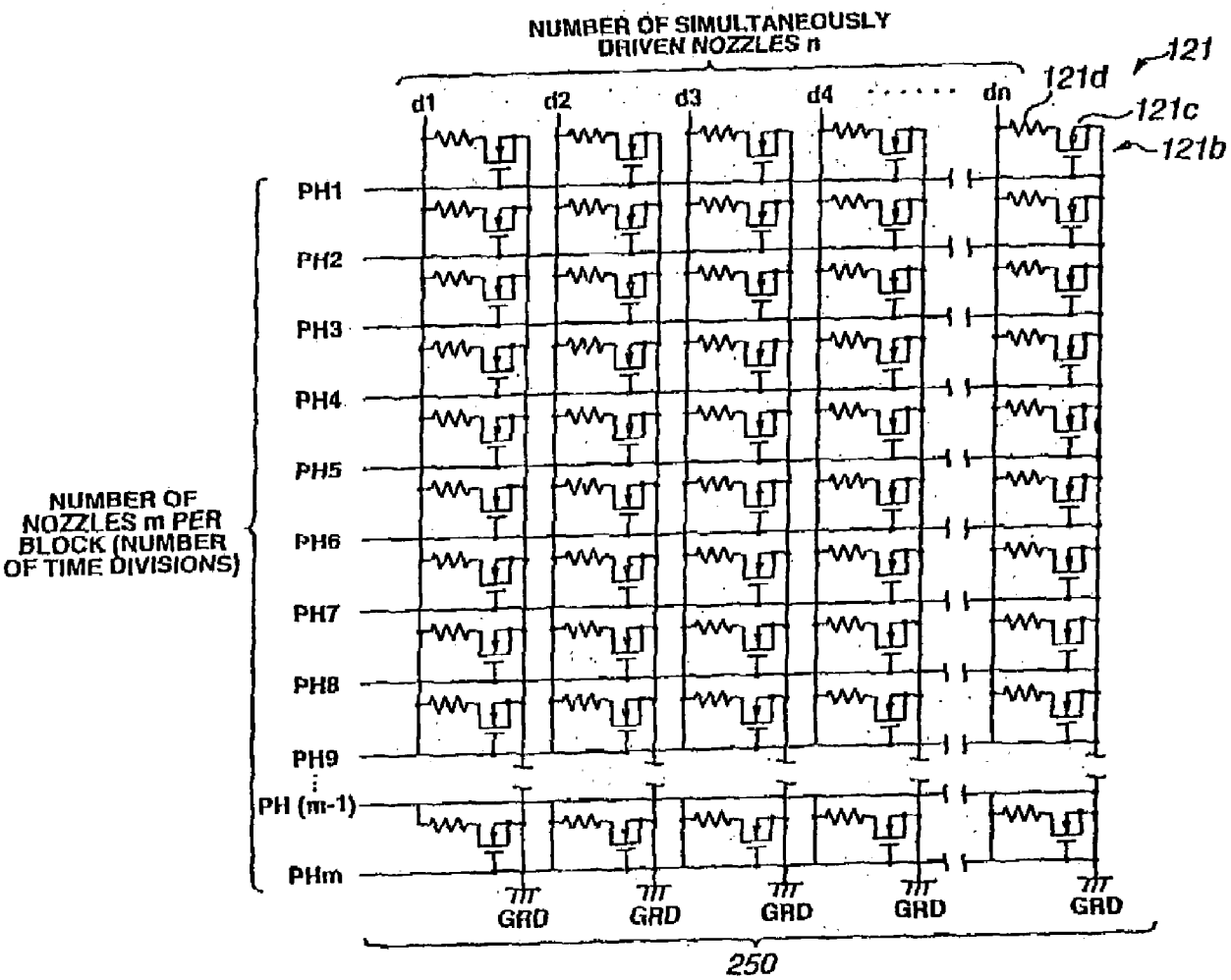
FIG. 28 is a circuit diagram showing an exemplary electrical structure of the head chip.

An exemplary electrical structure of the head chip 121 will now be described. A heater unit 250 is provided in the head chip 121, as partly shown in the circuit diagram of FIG. 28. The heater unit 250 has combinations of the switching element 121*c* and the heating element 121*d* of the same number as the number of nozzles 124*a*. These switching elements 121*c* and heating elements 121*d* are driven in a matrix by the gate circuit 121*b*. The gate circuit 121*b* is constituted as an AND gate for taking a logical product of a phase signal supplied from the time-division drive phase generating circuit 121*a* and output data supplied from the comparators 163*c*, that is, phase-corresponding data, as described above. When both the phase signal as a division drive signal and the phase-corresponding data as an element drive signal are high signals "H," the head chip 121 turns the switching elements 121*c* ON and drives the heating elements 121*d* to eject ink droplets from the nozzles 124*a*.

In this case, the phase signal as a division drive signal is indicated by symbols PH1, . . . , PHm provided for the number of time divisions, that is, the number of nozzles m per block, and the phase-corresponding data as an element drive signal is indicated by d1, . . . , dn provided for the number of simultaneously driven nozzles n. The phase-corresponding data d1, . . . , dn as element drive signals are data for driving the nozzles 124*a* when forming a pixel on the paper P, that is, necessary data for forming one dot. For example, when both the phase signal PH1, . . . , PHm and the phase-corresponding data d1, . . . , dn of a combination are high signals "H," the head chip 121 causes the gate circuit 121*b* to turn the corresponding switching element 121*c* ON. Thus, in the head chip 121, the heating elements 121*d* heats to eject ink droplets from the nozzle 124*a*, thus forming a pixel on the paper P.

Figure 29:
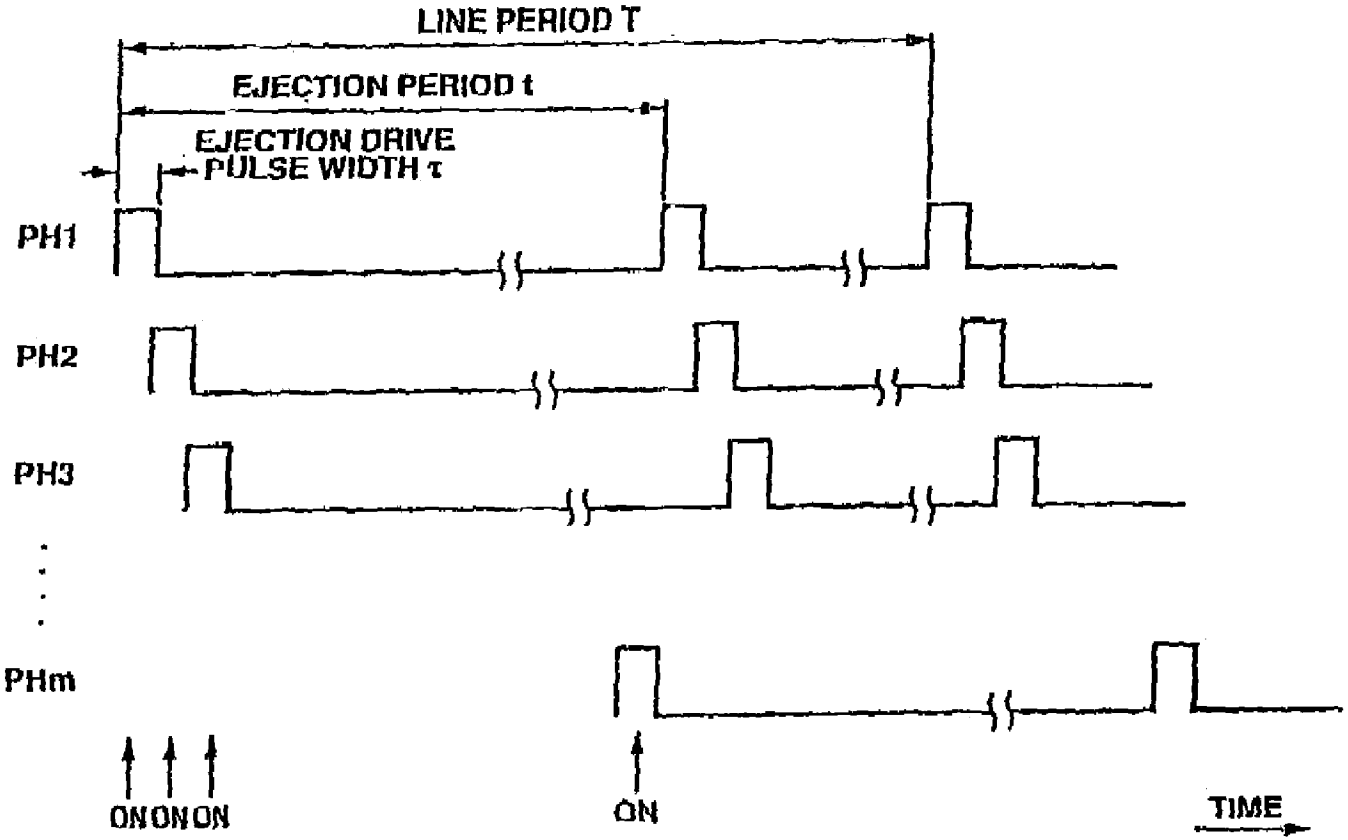
FIG. 29 is a chart showing the timing of output data outputted from the comparator.

FIG. 29 is a chart showing the timing of output data D outputted from the comparator 163*c*. FIG. 29 also shows an exemplary driving method in carrying out time-division drive in the line head 120. The number of time divisions and the number of simultaneously driven nozzles at that time are defined by the following relational expressions. For example, when the time period (line period) for printing a head width in one row by the line head 120 for one color capable of color printing is denoted by T and the pulse number in PNM at the time of multi-value recording is denoted by P, the maximum ejection frequency $t_{max}$ is expressed by the following equation (1).

$$t_{max}=T/P \tag{1}$$

When the total number of nozzles is N, the ejection drive pulse width is τ, and the ejection frequency is t (t≦tmax), the maximum number of time divisions A is expressed by the following equation (2).

$$A=t/\tau \tag{2}$$

Therefore, the number of time divisions m may be not more than the maximum number of time divisions A. A decimal point of the maximum number of time divisions A calculated by the equation (2) is rounded out. The number of simultaneously driven nozzles n in this case is expressed by the following equation (3).

$$n=N/A \tag{3}$$

A decimal point of the number of simultaneously driven nozzles n calculated by the equation (3) is rounded out, thus holding the relation of (number of time divisions m)×(number of simultaneously driven nozzles n)≦A.

For example, when the nozzle pitch is 600 dpi, the number of nozzles is 5100, the line recording frequency is 600 Hz, the pulse number in PNM is 8 and the instantaneous maximum dissipation power is 0.74 W, the dissipation power is calculated as shown in the following Table 2 based on the equations (1), (2) and (3).

TABLE 2

| Ejection drive pulse width τ(μs) | Number of nozzles per block m | Number of simultaneously driven nozzles n | Dissipation power per color (W) | Dissipation power for four color (W) |
|---|---|---|---|---|
| 1.5 | 138 | 37 | 27 | 110 |
| 1.0 | 204 | 25 | 19 | 74 |
| 1.8 | 255 | 20 | 15 | 59 |

The plurality of nozzles 124*a* eject ink droplets when the phase signals PH1, . . . , PHm with their phases shifted within the range of the ejection period t are inputted for each block. Thus, in the line head 120, since the number of simultaneously driven nozzles is reduced, the maximum dissipation power in driving can be lowered. Meanwhile, the number of simultaneously driven nozzles is changed by setting the (ejection drive pulse width τ)×(number of time divisions m) to be substantially constant in consideration of the ejection period t. Thus, the dissipation power in the case of using ink of one color or four colors, too, is lowered by the reduction in the number of simultaneously driven nozzles.

As described above, in the ink jet printer 100 as the first embodiment, since matrix drive is carried out in the head chip 121 by the circuit structure shown in FIG. 18, the number of wirings can be reduced. Moreover, the ink jet printer 100 can reduce the positional shift of dots for forming pixels on the paper P and carries out time-division drive by minimizing the number of simultaneously driven nozzles. Therefore, the instantaneous maximum dissipation power can be reduced.

Furthermore, since the multi-level recording within a pixel is made possible by carrying out PNM, the ink jet printer 100 can provide a recorded image of high definition with less rough or granular appearance can be provided at a high speed, in comparison with te conventional ink jet printer. By combining PNM with dot density modulation, the ink jet printer 100 can carry out not only binary but also multi-level dot density modulation and can carry out smoother gray scale printing of high definition. As a result, the ink jet printer 100 can realize high definition even with a small number of nozzles and therefore can reduce the number of nozzles and the work and assembly cost.

Moreover, by setting the recording time in consideration of the ink drying time and then carrying out time-division drive of multiple divisions which fully uses the recording time, the ink jet printer 100 can reduce the dissipation power. The ink jet printer 100 can also carry out correction of the quantity of ejection, that is, correction of the print density, using PNM, and thus can provide a smoother recorded image of high definition.

In addition, by carrying out recording while changing the ink droplet impact position on the paper in accordance with the pulse number so that the resultant dot is equivalent to a dot formed by distributing ink droplets in the paper feed direction from the lattice point as the center, the in jet printer 100 can provide a more accurate recorded image of high definition.

Moreover, by arranging the plurality of head chips 121 in a zigzag manner and providing the overlap part $\mathbf{124}_C$, the ink jet printer 100 can restrain the banding noise generated at the joint of the head chips 121, that is, at the joint of the nozzle groups.

Thus, the ink jet printer 100 is well balanced as a whole with respect to the picture quality, the speed and the dissipation power, and provides convenience for users.

An ink jet printer as a second embodiment will now be described. This ink jet printer has a basic structure similar to that of the ink jet printer 100 of the first embodiment, and is characterized by its ink droplet impacting method as a driving method based on the PNM system. Therefore, the same numerals and symbols as in the ink jet printer 100 are used in the following description.

Figure 30:
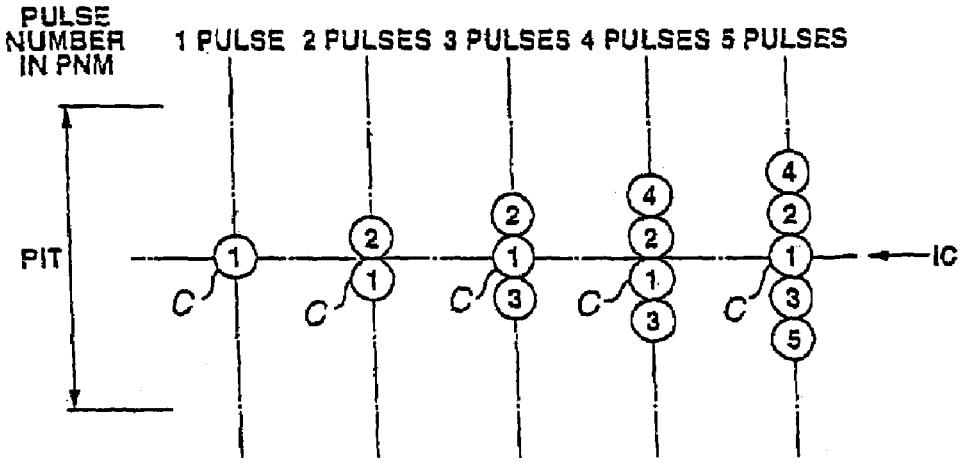
FIG. 30 shows an exemplary arrangement of dots to be recorded on the paper by using a method for driving a line head provided in an ink jet printer as a second embodiment of the present invention.

FIG. 30 shows an exemplary arrangement of dots to be recorded on the paper P by a method for driving the line head 120 provided in the ink jet printer 100 as the second embodiment. "PIT" in FIG. 30 represents the diameter of the dot D previously shown in FIG. 18 and is referred to as "pixel pitch" in this embodiment. Symbols "o" in FIG. 30 correspond to the record data after correction and numbers provided in "o" indicate the arrangement order of pulses to be objects of comparison with the record data from the comparators 163*c*. The positions of "o" corresponding to the record data in FIG. 30 are coincident with the positions of dots within a pixel in printing, that is, the positions of the dots d formed by the respective ink droplets I shown in FIG. 18. In the line head 120, the arrangement of the record data relative to the center of image IC is changed depending on the pulse number is an even number or an odd number, in forming one dot in accordance with the PNM system.

Specifically, when printing an image in accordance with the PNM system, the line head 120 sequentially distributes record data outward from a position C (hereinafter referred to as start point of pixel) indicating the first record data in image processing of ink droplets to be impacted, which is identical with the above-described lattice point. Moreover, the line head 120 is driven to impact ink droplets on the paper P by time-division drive based on the distributed record data, thus printing an image. In this case, the record data is set so that the dots to be printed fall within the range of the pixel pitch PIT. Since the paper P is carried into the predetermined paper feed direction, the dots are actually formed obliquely, not in a straight line indicating the start point of pixel C shown in FIG. 30.

In this manner, the ink jet printer 100 as the second embodiment can reduce the positional shift of dots on one line and can carry out matrix drive of the plurality of nozzles. Therefore, the number of wirings can be reduced. The ink jet printer 100 also can minimize the number of simultaneously driven nozzles and can reduce the dissipation power in driving.

An ink jet printer as a third embodiment will now be described. This ink jet printer has a basic structure similar to that of the ink jet printer 100 of the first embodiment, and is characterized by its ink droplet impacting method as a driving method based on the PNM system. Therefore, the same numerals and symbols as in the ink jet printer 100 are used in the following description.

Figure 31:
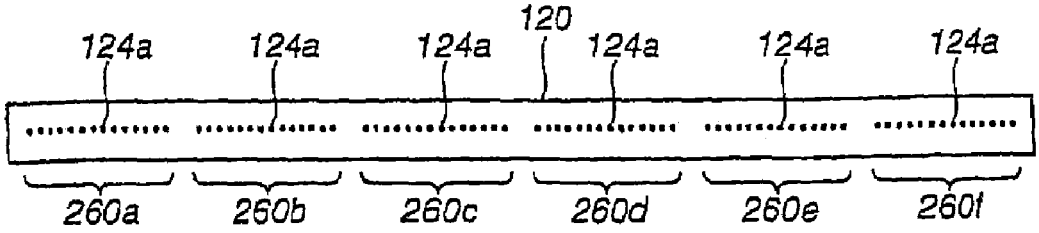
FIG. 31 is a plan view showing an exemplary structure of a line head provided in an ink jet printer as a third embodiment of the present invention.

FIG. 31 is a plan view showing an exemplary structure of the line head 120. The head chips are not shown in FIG. 31.

In the line head 120, a plurality of nozzles 124*a* arrayed substantially in a straight line (or in a zigzag manner) are divided into sets of nozzles, with each set consisting of a predetermined number of nozzles. The sets of nozzles are obtained by dividing the line head 120 in the real space and include, for example, a first nozzle set 260*a*, a second nozzle set 260*b*, a third nozzle set 260*c*, a fourth nozzle set 260*d*, a fifth nozzle set 260*e* and a sixth nozzle set 260*f* shown in FIG. 31. In the line head 120, the plurality of nozzles 124*a* in the respective nozzles sets are driven in a time-divisional manner by block. The ejection period t in this case is the time required for ejecting one ink droplet each from all the nozzles 124*a* included in the respective nozzle sets.

Figure 32:
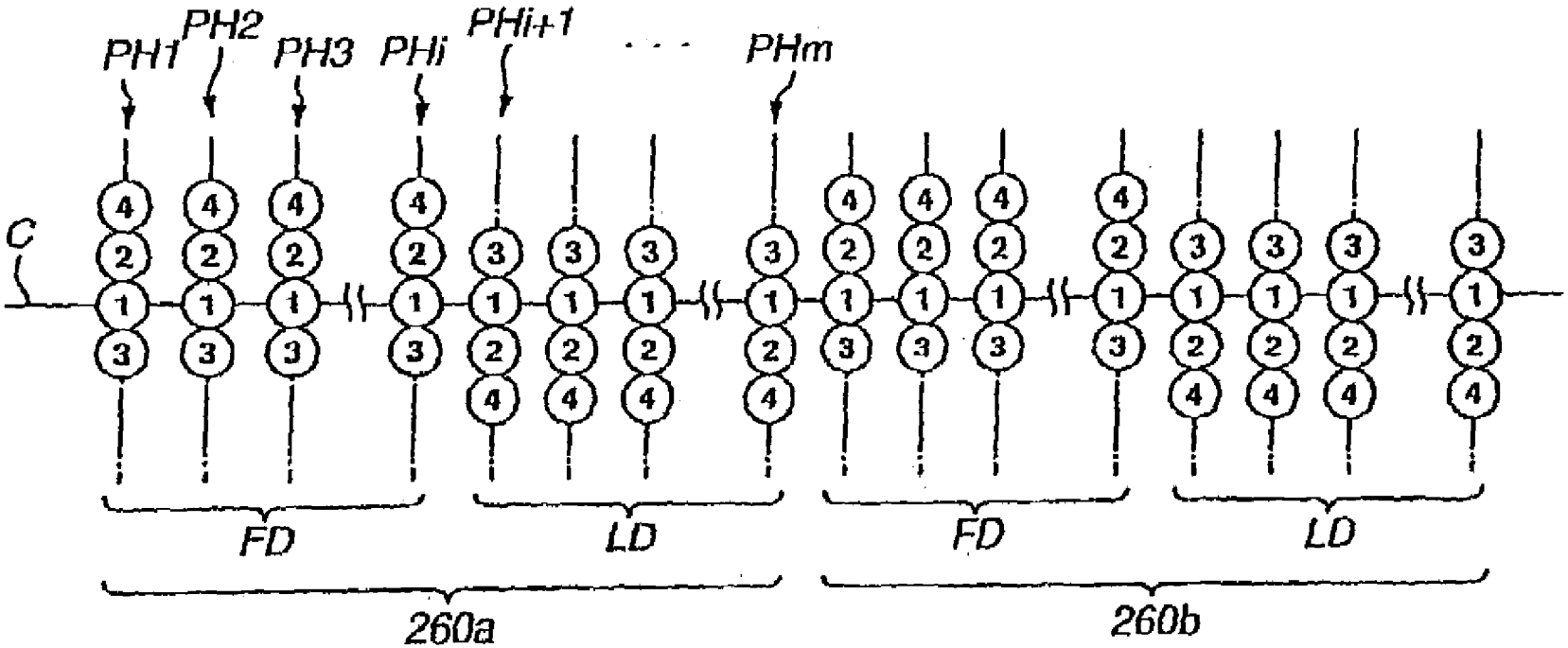
FIG. 32 shows an exemplary arrangement of dots to be recorded on the paper by using a method for driving the line head provided in the ink jet printer of FIG. 31.

FIG. 32 shows an exemplary arrangement of dots to be recorded on the paper P by the method for driving the line head 120. Symbols PH1, . . . , PHm appended above the dots in FIG. 32 indicate that the respective dots are printed on the basis of the above-described phase signals PH1, . . . , PHm. Symbols "o" in FIG. 32, similar to those shown in FIG. 30, correspond to the record data after correction and numbers provided in "o" indicate the arrangement order of pulses, that is, the arrangement order of pulses to be objects of comparison with the record data from the comparators 163*c*. The positions of "o" corresponding to the record data in FIG. 32 are coincident with the positions of dots within a pixel in printing, that is, the positions of the dots d formed by the respective ink droplets I shown in FIG. 18.

FIG. 32 shows exemplary recording data showing the exemplary arrangement of dots for dot impact up to four pulses in accordance with the PNM system. In the line head 120, the record data in image processing for ejecting ink droplets from the nozzles 124*a* included in one nozzle set is temporally divided into two, that is, the former half record data FD and latter half record data LD. In the line head 120, in printing an image by using the PNM system, for example, the former half record data FD is sequentially distributed outward from a start point of pixel C and the latter half record data LD is sequentially distributed outward from the start point of pixel C so that the record data based on the pulses of odd ordinal numbers and the record data based on the pulses of even ordinal numbers are arranged on the opposite sides of the start point of pixel C to those of the former half record data FD, as shown in FIG. 32. Other distribution methods may also be used as long as the latter half record data LD is distributed differently from the former half record data FD. Therefore, in this record data distribution method, at least the way of distributing former half record data FD need to be held and any distribution manner may be used for the latter half record data LD. Of course, the former half record data and the latter half record data may be distributed similarly.

By carrying out time-division driving in accordance with the record data thus distributed, the line head 120 impacts ink droplets on the paper P. Since the paper P is carried into the predetermined paper feed direction, the dots are actually formed obliquely, not in a straight line indicating the start point of pixel C shown in FIG. 32. With respect to the record data based on the pulses of even ordinal numbers, the former half record data FD and the latter half record data LD are slightly shifted from each other. Therefore, in the line head 120, by preparing the record data in consideration of the paper feed direction of the paper P, the positional shift of the dots impacted on the paper P can be made less visually recognizable.

The ink jet printer 100 as the third embodiment, similar to the ink jet printer 100 of the second embodiment, can reduce the positional shift of dots on one line and can carry out matrix drive of the plurality of nozzles, thus reducing the number of wirings. The ink jet printer 100 can also minimize the number of simultaneously driven nozzles and can reduce the dissipation power in driving. In addition, since the ink jet printer 100 prints, for example, one line with dots by further dividing the plurality of nozzles 124*a* in the line head 120 into smaller units, the ink jet printer 100 can further reduce the positional shift of dots on one line.

An ink jet printer as a fourth embodiment will now be described. This ink jet printer has a basic structure similar to that of the ink jet printer 100 of the first embodiment, and is characterized by its ink droplet impacting method as a driving method based on the PNM system. Therefore, the same numerals and symbols as in the ink jet printer 100 are used in the following description.

Figure 33:
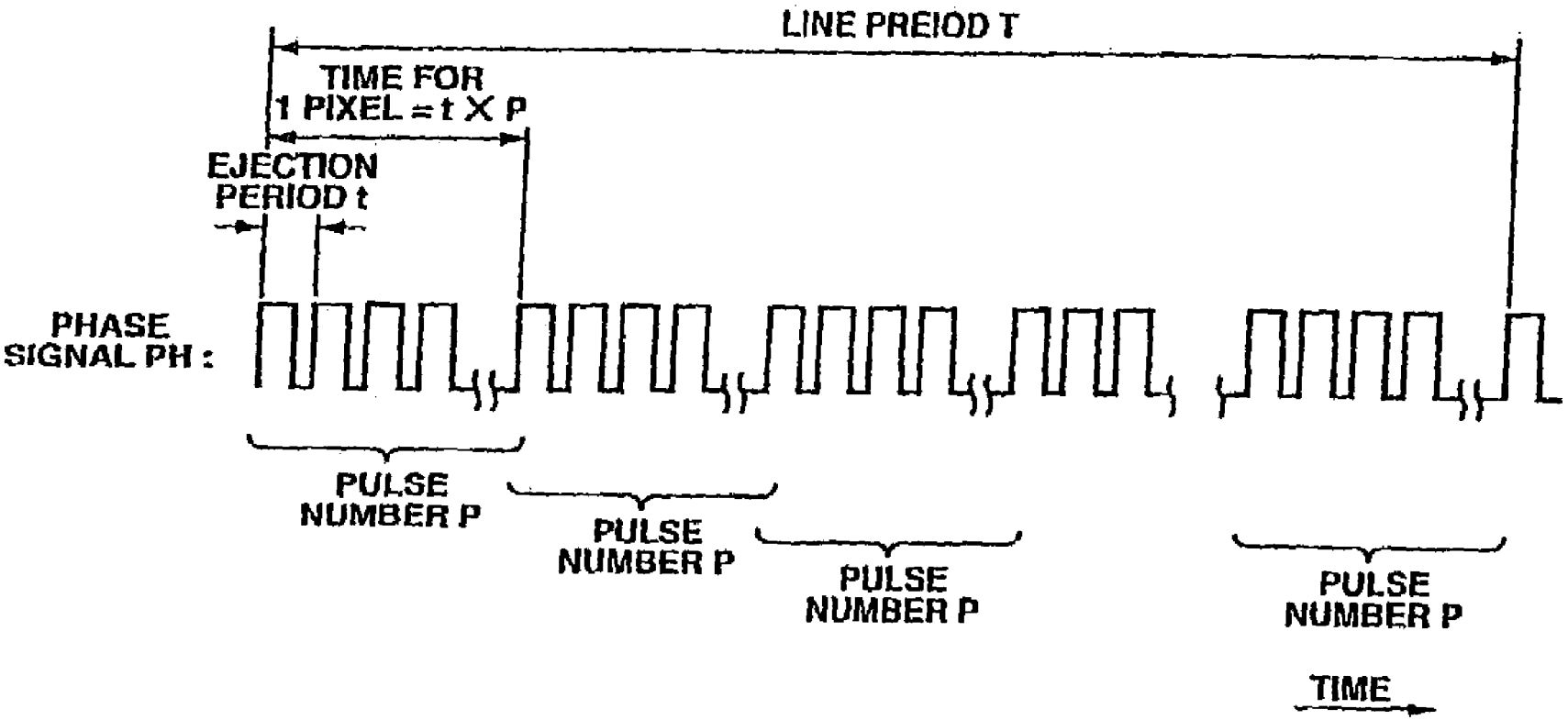
FIG. 33 is a chart showing exemplary timing of a phase signal outputted from a time-division drive phase generating circuit in a line head provided in an ink jet printer as a fourth embodiment of the present invention.

FIG. 33 is a chart showing exemplary timing of a phase signal outputted from the time-division drive phase generating circuit 121*a* shown in FIG. 6.

The time-division drive phase generating circuit 121*a* outputs a pulse-like phase signal PH in a line period T. The phase signal PH is a pulse-like signal generated every ejection period t, which is a period for ejecting an ink droplet from the nozzle 121*a*. The phase signal PH is outputted during the entire line period T. The line period T is expressed by (pulse number P)×(ejection period t) for forming one pixel on the paper P. The respective phase signal PH of the line period T is provided for each block.

The line head 120 prints one dot by using one nozzle and is driven to sequentially print one dot each by the second nozzle, the third nozzle, . . . , the m-th nozzle, as shown in FIG. 33. In the line head 120, when the line period is T, the ejection period is t and the pulse number for one pixel in accordance with PNM is P, the number of time divisions m is expressed by the following equation (4).

$$m=T/(t\times P) \quad (4)$$

A decimal point of the number of time divisions m calculated by the equation (4) is rounded out. In this case, the number of simultaneously driven nozzles n is expressed by the following equation (5), where the total number of nozzles is N.

$$n=N/m \quad (5)$$

A decimal point of the number of simultaneously driven nozzles n calculated by the equation (5) is rounded out.

The ink jet printer 100 as the fourth embodiment, similar to the ink jet printer 100 of the first embodiment, can reduce the positional shift of dots on one line and can carry out matrix drive of the plurality of nozzles, thus reducing the number of wirings. The ink jet printer 100 can also minimize the number of simultaneously driven nozzles and can reduce the dissipation power in driving.

An ink jet printer as a fifth embodiment will now be described. This ink jet printer has a basic structure similar to that of the ink jet printer 100 of the first embodiment, and is characterized in that phase signals, which are division drive signals in carrying out time-division drive, are generated corresponding to the number of time divisions, by multi-dimensional input signals. Therefore, the same portions as those of the above-described ink jet printer 100 are denoted by the same numerals and symbols.

In the ink jet printer 100, for example, when the time period (line period) for printing a head width in one row with the line head 120 for one color is denoted by T and the pulse number in PNM at the time of multi-value recording is denoted by P, the maximum ejection frequency $t_{max}$ is expressed by the following equation (6), similar to the equation (1).

$$t_{max}=T/P \quad (6)$$

When the total number of nozzles is N, the ejection drive pulse width is $\tau$, and the ejection frequency is t ($t \leqq t_{max}$), the maximum number of time divisions A is expressed by the following equation (7), similar to the equation (2).

$$A=t/\tau \quad (7)$$

Therefore, the number of time divisions m may be not more than the maximum number of time divisions A. A decimal point of the maximum number of time divisions A calculated by the equation (7) is rounded out. The number of simultaneously driven nozzles n in this case is expressed by the following equation (8), similar to the equation (3).

$$n=N/A \quad (8)$$

A decimal point of the number of simultaneously driven nozzles n calculated by the equation (8) is rounded out, thus holding the relation of (number of time divisions m)× (number of simultaneously driven nozzles n)$\leqq$A.

In the line head 120, the maximum number of time divisions A is further divided into two dimensions as expressed by the following equation (9), thus carrying out driving.

$$A=m_1\times m_2 \quad (9)$$

In the equation (9), m1 represents A1, . . . , Ai in FIG. 34 and $m_2$ represents AA1, . . . , AAj in FIG. 34, as will be described later.

Figure 34:
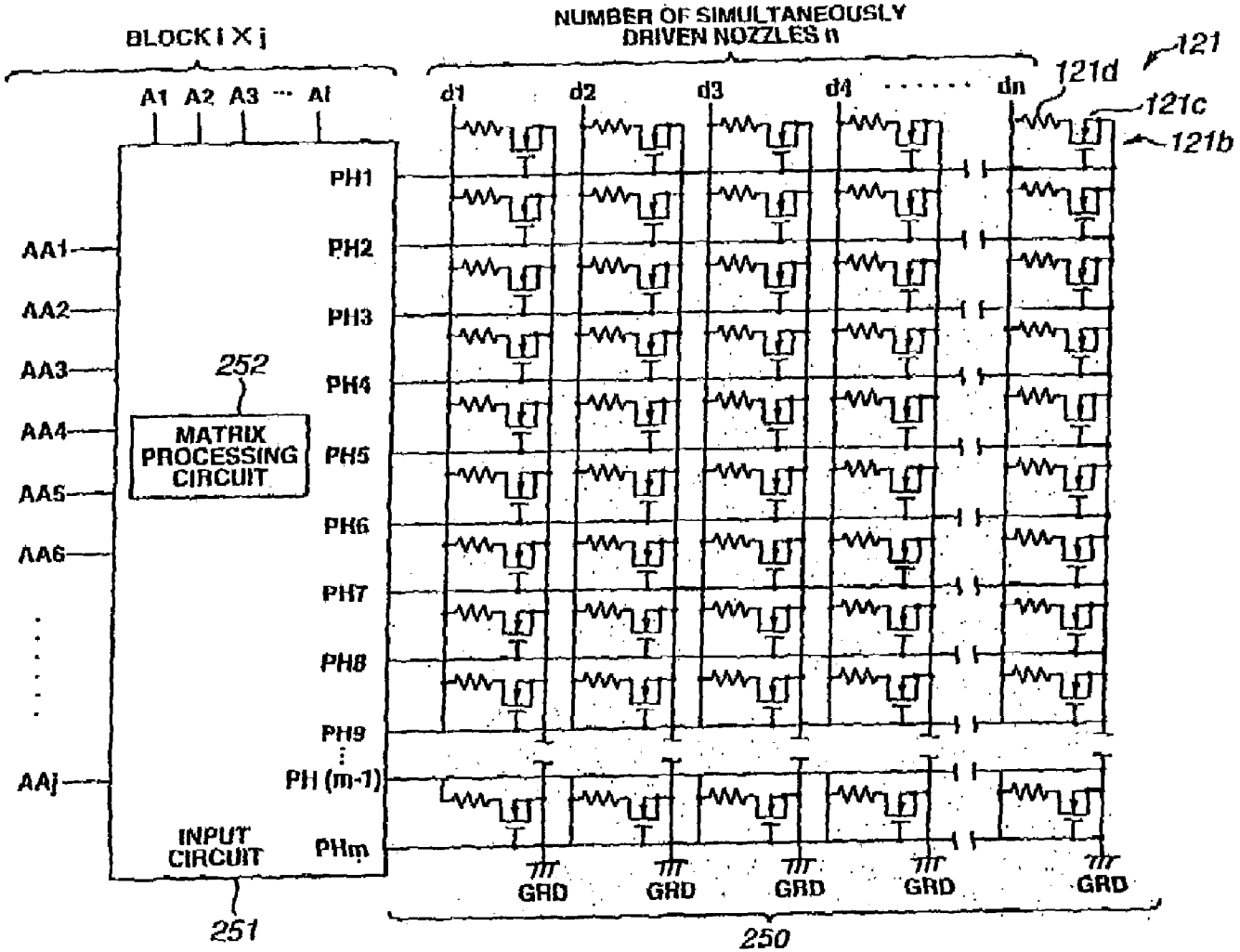
FIG. 34 is a circuit diagram showing an exemplary electrical structure of a head chip in a line head provided in an ink jet printer as a fifth embodiment of the present invention.

The schematic circuit of the heater unit 250 in this time-division drive is shown in FIG. 34. In the head chip 120, an input circuit 251 is provided in addition to the heat unit 250 shown in FIG. 28, as partly shown in the circuit diagram of FIG. 34.

The input circuit 251 is adapted for generating phase signals PH1, . . . , PHm to be supplied to the heater unit 250 and has a matrix processing circuit 252. First input signals A1, . . . , Ai and second input signals AA1, . . . , AAj are inputted to the input circuit 251. The input circuit 251 generates phase signals PH1, . . . , PHm on the basis of the first input signals A1, . . . , Ai and the second input signals AA1, . . . , AAj.

The matrix processing circuit 252 forms a matrix on the basis of the first input signals A1, . . . , Ai and the second input signals AA1, . . . , AAj. The matrix processing circuit 252 is constituted so that when one of the first input signals A1, . . . , Ai and one of the second input signals AA1, . . . , AAj are high signals "H," one or a combination of the corresponding phase signals PH1, . . . , PHm becomes a high signal "H." Therefore, the number of signals of the first input signals A1, . . . , Ai and the second input signals AA1, . . . , AAj may be smaller tan the number of signals of the phase signals PH1, . . . , PHm.

In the line head 120 having the head chip 121 as described above, matrix drive can be carried out by using the three-dimensional data groups of the first input signals A1, . . . , Ai, the second input signals AA1, . . . , AAj, and the phase-corresponding data d1, . . . , dn as element drive signals.

As described above, the ink jet printer 100 as the fifth embodiment, similar to the ink jet printer 100 of the first embodiment, can reduce the positional shift of dots on one line and can carry out matrix drive of the plurality of nozzles, thus reducing the number of wirings. The ink jet printer 100 can also minimize the number of simultaneously driven nozzles and can reduce the dissipation power in driving. In addition, the ink jet printer 100 can carry out three-dimensional matrix drive of the plurality of nozzles 124*a* and can further reduce the number of wirings for signal lines to control the input to the head chips 121. Thus, the electrical structure of the head chips 121 can be further simplified.

The present invention is not limited the above-described embodiments. For example, though the head chips are arranged in a zigzag manner in the above-described embodiments, the present invention can also be applied to a line head in which head chips are arranged substantially in a straight line.

The present invention may also be applied to the method for driving a line head of the fourth embodiment combined with the method for processing record data described in the second embodiment. In this case, similar to the second embodiment, the ink jet printer can reduce the positional shift of dots on one line and can reduce the number of wirings by carrying out matrix drive of a plurality of nozzles. Moreover, the ink jet printer can minimize the number of simultaneously driven nozzles and can also reduce the dissipation power in driving.

Furthermore, the present invention may also be applied to the method for driving a line head of the fourth embodiment combined with the method for processing record data described in the third embodiment. In this case, similar to the second embodiment, the ink jet printer can reduce the positional shift of dots on one line and can reduce the number of wirings by carrying out matrix drive of a plurality of nozzles. Moreover, the ink jet printer can minimize the number of simultaneously driven nozzles and can also reduce the dissipation power in driving. In addition, since the ink jet printer prints, for example, one line with dots by further dividing the plurality of nozzles in the line head into smaller units, the ink jet printer can further reduce the positional shift of dots on one line.

Moreover, the line head of the fifth embodiment may also be driven by the method for processing record data or time-division drive described in the second to fourth embodiments. The ink jet printer having such a line head can realize the same effects as in the ink jet printers of the second to fourth embodiment as well as in the ink jet printer of the fifth embodiment. Similarly, the line head of the fifth embodiment may also be adapted for the method for driving a line head of the fourth embodiment combined with the method for processing record data of the second embodiment, or may also be adapted for the method for driving a line head of the fourth embodiment combined with the method for processing record data of the third embodiment.

Although the line heads for a plurality of colors are assumed in the above-described embodiments, the present invention may also be applied to a line head for one color.

Thus, various modifications and changes may be effected without departing from the scope of the present invention.

INDUSTRIAL APPLICABILITY

As is described above in detail, the method for driving a recording head according to the present invention is a method for driving a recording head having a plurality of heating elements as driving elements for ejecting ink droplets from a plurality of nozzles, the plurality of heating elements being arranged in a direction substantially perpendicular to the direction of carrying a carried recording medium, the method comprising: a time-division driving step of dividing the plurality of heating elements into a plurality of blocks, each block consisting of a predetermined number of spatially arranged heating elements of the plurality of heating elements corresponding to the plurality of nozzles, and sequentially driving each set of heating elements simultaneously driven over the respective blocks, in a time-divisional manner; and a recording step of ejecting ink droplets from the nozzles corresponding to the driven heating elements and impacting the ink droplets on the recording medium, thus recording dots made of the ink droplets.

Therefore, in the method for driving a recording head according to the present invention, since the heating elements are sequentially driven in a time-divisional manner by each set of heating elements simultaneously driven over the respective divided blocks, the positional shift of dots on the recording medium can be reduced and the instantaneous maximum dissipation power in time-division drive can be reduced.

The recording head according to the present invention is a recording head having a plurality of heating elements as driving elements for ejecting ink droplets from a plurality of nozzles, the plurality of heating elements being arranged in a direction substantially perpendicular to the direction of carrying a carried recording medium, the recording head comprising: time-division driving means for dividing the plurality of heating elements into a plurality of blocks, each block consisting of a predetermined number of spatially arranged heating elements of the plurality of heating elements corresponding to the plurality of nozzles, and sequentially driving each set of heating elements simultaneously driven over the respective blocks, in a time-divisional manner; and recording means for ejecting ink droplets from the nozzles corresponding to the driven heating elements and impacting the ink droplets on the recording medium, thus recording dots made of the ink droplets.

Therefore, in the recording head according to the present invention, since the heating elements are sequentially driven in a time-divisional manner by each set of heating elements simultaneously driven over the respective divided blocks, the positional shift of dots on the recording medium can be reduced and the instantaneous maximum dissipation power in time-division drive can be reduced.

The ink jet printer according to the present invention is an ink jet printer having a recording head having a plurality of heating elements as driving elements for ejecting ink droplets from a plurality of nozzles, the plurality of heating elements being arranged in a direction substantially perpendicular to the direction of carrying a carried recording medium, the ink jet printer being adapted for recording information including a character and/or an image in the form of dots made of ink droplets, the ink jet printer comprising: time-division driving means for dividing the plurality of heating elements into a plurality of blocks, each block consisting of a predetermined number of spatially arranged heating elements of the plurality of heating elements corresponding to the plurality of nozzles, and sequentially driving each set of heating elements simultaneously driven over the respective blocks, in a time-divisional manner; and recording means for ejecting ink droplets from the nozzles corresponding to the driven heating elements and impacting the ink droplets on the recording medium, thus recording dots made of the ink droplets.

Therefore, in the ink jet printer according to the present invention, since the heating elements are sequentially driven in a time-divisional manner by each set of heating elements simultaneously driven over the respective divided blocks, the positional shift of dots on the recording medium can be reduced and the instantaneous maximum dissipation power in time-division drive can be reduced.

Moreover, the method for driving a recording head according to the present invention is a method for driving a recording head having a plurality of heating elements as driving elements for ejecting ink droplets from a plurality of nozzles, the plurality of heating elements being arranged in a direction substantially perpendicular to the direction of carrying a carried recording medium, the method comprising: a drive signal generating step of generating an element drive signal made of necessary data for forming one dot so as to modulate the diameter of a dot by the number of ink droplets, using one or a plurality of ink droplets for forming one dot; a time-division driving step of dividing the plurality of heating elements into a plurality of blocks, each block consisting of a predetermined number of spatially arranged heating elements of the plurality of heating elements corresponding to the plurality of nozzles, and sequentially driving each set of heating elements simultaneously driven over the respective blocks, in a time-divisional manner; and a recording step of ejecting one or a plurality of ink droplets from the nozzles corresponding to the driven heating elements and impacting the ink droplet(s) on the recording medium, thus recording dots made of the ink droplet(s).

Therefore, in the method for driving a recording head according to the present invention, since the heating elements are driven so as to modulate the diameter of a dot by the number of ink droplets and the heating elements are sequentially driven in a time-divisional manner by each set of heating elements simultaneously driven over the respective divided blocks, the positional shift of dots on the recording medium can be reduced and the instantaneous maximum dissipation power in time-division drive can be reduced. Moreover, gray scales can be expressed within a pixel and a recorded image of high definition with less rough or granular appearance can be provided at a high speed.

The recording head according to the present invention is a recording head having a plurality of heating elements as driving elements for ejecting ink droplets from a plurality of nozzles, the plurality of heating elements being arranged in a direction substantially perpendicular to the direction of carrying a carried recording medium, the recording head comprising: drive signal generating means for generating an element drive signal made of necessary data for forming one dot so as to modulate the diameter of a dot by the number of ink droplets, using one or a plurality of ink droplets for forming one dot; time-division driving means for dividing the plurality of heating elements into a plurality of blocks, each block consisting of a predetermined number of spatially arranged heating elements of the plurality of heating elements corresponding to the plurality of nozzles, and sequentially driving each set of heating elements simultaneously driven over the respective blocks, in a time-divisional manner; and recording means for ejecting one or a plurality of ink droplets from the nozzles corresponding to the driven heating elements and impacting the ink droplet(s) on the recording medium, thus recording dots made of the ink droplet(s).

Therefore, in the recording head according to the present invention, since the heating elements are driven so as to modulate the diameter of a dot by the number of ink droplets and the heating elements are sequentially driven in a time-divisional manner by each set of heating elements simultaneously driven over the respective divided blocks, the positional shift of dots on the recording medium can be reduced and the instantaneous maximum dissipation power in time-division drive can be reduced. Moreover, gray scales can be expressed within a pixel and a recorded image of high definition with less rough or granular appearance can be provided at a high speed.

The ink jet printer according to the present invention is an ink jet printer having a recording head having a plurality of heating elements as driving elements for ejecting ink droplets from a plurality of nozzles, the plurality of heating elements being arranged in a direction substantially perpendicular to the direction of carrying a carried recording medium, the ink jet printer being adapted for recording information including a character and/or an image in the form of dots made of ink droplets, the ink jet printer comprising: drive signal generating means for generating an element drive signal made of necessary data for forming one dot so as to modulate the diameter of a dot by the number of ink droplets, using one or a plurality of ink droplets for forming one dot; time-division driving means for dividing the plurality of heating elements into a plurality of blocks, each block consisting of a predetermined number of spatially arranged heating elements of the plurality of heating elements corresponding to the plurality of nozzles, and sequentially driving each set of heating elements simultaneously driven over the respective blocks, in a time-divisional manner; and recording means of ejecting one or a plurality of ink droplets from the nozzles corresponding to the driven heating elements and impacting the ink droplet(s) on the recording medium, thus recording dots made of the ink droplet(s).

Therefore, in the ink jet printer according to the present invention, since the heating elements are driven so as to modulate the diameter of a dot by the number of ink droplets and the heating elements are sequentially driven in a time-divisional manner by each set of heating elements simultaneously driven over the respective divided blocks, the positional shift of dots on the recording medium can be reduced and the instantaneous maximum dissipation power in time-division drive can be reduced. Moreover, gray scales can be expressed within a pixel and a recorded image of high definition with less rough or granular appearance can be provided at a high speed.

The invention claimed is:

1. A method for driving a recording head having a plurality of heating elements as driving elements for ejecting ink droplets from a plurality of nozzles, the plurality of heating elements being arranged in a direction substantially perpendicular to the direction of carrying a carried recording medium, the method comprising:

a time-division driving step of dividing the plurality of heating elements into a plurality of blocks, each block consisting of a predetermined number of spatially and sequentially arranged heating elements of the plurality of heating elements corresponding to the plurality of nozzles, respective ones of the heating elements and the corresponding nozzles in each block positioned similarly to form respective positional sets and sequentially driving each set of heating elements and corresponding nozzles simultaneously driven over the respective blocks, in a time-divisional manner in a driving order in which none of the next-driven heating elements is adjacent to any of the immediately previously-driven heating elements; and a recording step of ejecting ink droplets from the nozzles corresponding to the driven heating elements and impacting the ink droplets on the recording medium, thus recording dots made of the ink droplets, wherein the time-divisional manner includes a number of time divisions and the number of time divisions is related to a number of simultaneously driven nozzles as follows:

$$t_{max}=T/P \quad (1)$$

$$A=t/\tau \quad (2)$$

$$n=N/A \quad (3)$$

and $$m\times n\leqq A \quad (4)$$

where $t_{max}$ is a maximum ink ejection frequency;

T is a time period for printing a head width in one row by a line head for one color capable of color printing;

P is a pulse number of a conventional pulse number modulation system;

t is less than $t_{max}$;

$\tau$ is an ejection pulse width;

N is a total number of nozzles;

A is a maximum number of time divisions;

n is the number of simultaneously driven nozzles rounded out to a whole number; and m is a number of time divisions.

2. The method for driving a recording head as claimed in claim 1, wherein at the time-division driving step, the heating elements are driven on the basis of a division dive signal generated for said each set and an element drive signal, which is a signal for driving the heating elements and is made up of necessary data for forming one dot.

3. The method for driving a recording head as claimed in claim 2, wherein at the time-division driving step, the division drive signals corresponding to the number of time divisions are generated by multi-dimensional input signals.

4. A recording head having a plurality of heating elements as driving elements for ejecting ink droplets from a plurality of nozzles, the plurality of heating elements being arranged in a direction substantially perpendicular to the direction of carrying a carried recording medium, the recording head comprising:

time-division driving means for dividing the plurality of heating elements into a plurality of blocks, each block consisting of a predetermined number of spatially and sequentially arranged heating elements of the plurality of heating elements corresponding to the plurality of nozzles, respective ones of the heating elements and the corresponding nozzles in each block positioned similarly to form respective positional sets and sequentially driving each set of heating elements and corresponding nozzles simultaneously driven over the respective blocks, in a time-divisional manner, in a driving order in which none of the next-driven heating elements is adjacent to any of the immediately previously-driven heating elements; and recording means for ejecting ink droplets from the nozzles corresponding to the driven heating elements and impacting the ink droplets on the recording medium, thus recording dots made of the ink droplets, wherein the time-divisional manner includes a number of time divisions and the number of time divisions is related to a number of simultaneously driven nozzles as follows:

$$t_{max}=T/P \quad (1)$$

$$A=t/\tau \quad (2)$$

$$n=N/A \quad (3)$$

and $$m\times n\leqq A \quad (4)$$

where $t_{max}$ is a maximum ink ejection frequency;

T is a time period for printing a head width in one row by a line head for one color capable of color printing;

P is a pulse number of a conventional pulse number modulation system;

t is less than $t_{max}$;

$\tau$ is an ejection pulse width;

N is a total number of nozzles;

A is a maximum number of time divisions;

n is the number of simultaneously driven nozzles rounded out to a whole number; and m is a number of time divisions.

5. The recording head as claimed in claim 4, wherein the time-division driving means drives the heating elements on the basis of a division dive signal generated for said each set and an element drive signal, which is a signal for driving the heating elements and is made up of necessary data for forming one dot.

6. The recording head as claimed in claim 5, wherein the time-division driving means generates the division drive signals corresponding to the number of time divisions by multi-dimensional input signals.

7. An ink jet printer having a recording head having a plurality of heating elements as driving elements for ejecting ink droplets from a plurality of nozzles, the plurality of heating elements being arranged in a direction substantially perpendicular to the direction of carrying a carried recording medium, the ink jet printer being adapted for recording information including a character and/or an image in the form of dots made of ink droplets, the ink jet printer comprising:

electric circuit unit for dividing the plurality of heating elements into a plurality of blocks, each block consisting of a predetermined number of spatially arranged heating elements of the plurality of heating elements corresponding to the plurality of nozzles, and sequentially driving each set of heating elements and corresponding nozzles simultaneously driven over the respective blocks, in a time-divisional manner in a driving order in which none of the next-driven heating elements is adjacent to any of the immediately previously-driven heating elements, the plurality of blocks arranged in first and second rows extending in a sub scanning direction and spaced apart from one another in a main scanning direction to form a zigzag array with end ones of the nozzles in the blocks in the first row overlapping end ones of the nozzles in the blocks in the second row such that the end of ones of the nozzles in the first row and the end ones of the nozzles in the second row share respective common center lines extending in the main scanning direction; and head chip for ejecting ink droplets from the nozzles corresponding to the driven heating elements and impacting the ink droplets on the recording medium, thus recording dots made of the ink droplets, wherein the time-divisional manner includes a number of time divisions and the number of time divisions is related to a number of simultaneously driven nozzles as follows:

$$t_{max}=T/P \quad (1)$$

$$A=t/\tau \quad (2)$$

$$n=N/A \quad (3)$$

and $$m\times n\leqq A \quad (4)$$

where $t_{max}$ is a maximum ink ejection frequency;

T is a time period for printing a head width in one row by a line head for one color capable of color printing;

P is a pulse number of a conventional pulse number modulation system;

t is less than $t_{max}$;

$\tau$ is an ejection pulse width;

N is a total number of nozzles;

A is a maximum number of time divisions;

n is the number of simultaneously driven nozzles rounded out to a whole number; and m is a number of time divisions.

8. The ink jet printer as claimed in claim 7, wherein the electric circuit unit drives the heating elements on the basis of a division dive signal generated for said each set and an element drive signal, which is a signal for driving the heating elements and is made up of necessary data for forming one dot.

9. The ink jet printer as claimed in claim 8, wherein the electric circuit unit generates the division drive signals corresponding to the number of time divisions by multi-dimensional input signals.

10. A method for driving a recording head having a plurality of heating elements as driving elements for ejecting ink droplets from a plurality of nozzles, the plurality of heating elements being arranged in a direction substantially perpendicular to the direction of carrying a carried recording medium, the method comprising:

a drive signal generating step of generating an element drive signal made of necessary data for forming one dot so as to modulate the diameter of a dot by the number of ink droplets, using one or a plurality of ink droplets for forming one dot;

a time-division driving step of dividing the plurality of heating elements into a plurality of blocks, each block consisting of a predetermined number of spatially arranged heating elements of the plurality of heating elements corresponding to the plurality of nozzles, and sequentially driving each set of heating elements and corresponding nozzles simultaneously driven over the respective blocks, in a time-divisional manner in a driving order in which none of the next-driven heating elements is adjacent to any of the immediately previously-driven heating elements;

a correcting unevenness step of correcting unevenness of print density by controlling pulse number moderation by adding or subtracting pulses for ejecting ink droplets in quantities fixed by the respective nozzles to compensate at least in part for desired target quantities of ink droplets to correct unevenness of print density; and a recording step of ejecting one or a plurality of ink droplets from the nozzles corresponding to the driven heating elements and impacting the ink droplet(s) on the recording medium, thus recording dots made of the ink droplet(s), wherein the time-divisional manner includes a number of time divisions and the number of time divisions is related to a number of simultaneously driven nozzles as follows:

$$t_{max}=T/P \quad (1)$$

$$A=t/\tau \quad (2)$$

$$n=N/A \quad (3)$$

and $$m\times n\leqq A \quad (4)$$

where $t_{max}$ is a maximum ink ejection frequency;

T is a time period for printing a head width in one row by a line head for one color capable of color printing;

P is a pulse number of a conventional pulse number modulation system;

t is less than $t_{max}$;

$\tau$ is an ejection pulse width;

N is a total number of nozzles;

A is a maximum number of time divisions;

n is the number of simultaneously driven nozzles rounded out to a whole number; and m is a number of time divisions.

11. The method for driving a recording head as claimed in claim 10, wherein at the time-division driving step, the heating elements are driven on the basis of a division dive signal generated for said each set and an element drive signal generated at the drive signal generating step for driving the heating elements belonging to said set designated by the division drive signal.

12. The method for driving a recording head as claimed in claim 11, wherein at the time-division driving step, the division drive signals corresponding to the number of time divisions are generated by multi-dimensional input signals.

13. The method for driving a recording head as claimed in claim 10, wherein at the drive signal generating step, record data made up of necessary data for forming one dot is compared with the number of pulses generated for determining the number of said ink droplets to be ejected from the nozzles, and the result of comparison is outputted as the element drive signal.

14. The method for driving a recording head as claimed in claim 13, wherein at the drive signal generating step, the order of the pulses to be objects of comparison with the record data is determined so that a dot to be formed on the recording medium is equivalent to a dot formed by distributing the ink droplets in the direction of carrying the recording medium from a lattice point as the center, which is the position on the recording medium in forming one dot with one said ink droplet.

15. The method for driving a recording head as claimed in claim 14, wherein at the drive signal generating step, in the case of forming one dot with the ink droplets of even ordinal numbers, the order of the pulses to be objects of comparison with the record data is determined so that the resultant dot is equivalent to a dot formed by distributing the ink droplets of odd ordinal numbers and the ink droplets of even ordinal numbers in the direction of carrying the recording medium symmetrically about the lattice point as the center, and in the case of forming one dot with the ink droplets of odd ordinal numbers, the order of the pulses to be objects of comparison with the record data is determined so that the resultant dot is equivalent to a dot formed by impacting the first ink droplet on the lattice point and then distributing the ink droplets of odd ordinal numbers and the ink droplets of even ordinal numbers in the direction of carrying the recording medium symmetrically about the lattice point as the center.

16. The method for driving a recording head as claimed in claim 14, wherein at the recording step, recording is carried out while the position on the recording medium where the ink droplet should be impacted is changed in accordance with the number of pulses generated at the drive signal generating step.

17. A recording head having a plurality of heating elements as driving elements for ejecting ink droplets from a plurality of nozzles, the plurality of heating elements being arranged in a direction substantially perpendicular to the direction of carrying a carried recording medium, the recording head comprising:

drive signal generating means for generating an element drive signal made of necessary data for forming one dot so as to modulate the diameter of a dot by the number of ink droplets, using one or a plurality of ink droplets for forming one dot;

time-division driving means for dividing the plurality of heating elements into a plurality of blocks, each block consisting of a predetermined number of spatially arranged heating elements of the plurality of heating elements corresponding to the plurality of nozzles, and sequentially driving each set of heating elements and corresponding nozzles simultaneously driven over the respective blocks, in a time-divisional manner in a driving order in which none of the next-driven heating elements is adjacent to any of the immediately previously-driven heating elements;

distribution means for distributing the ejected ink drops on the carried recording medium using phase-corresponding data with respect to pulse numbers so that at least a first resultant dot having a first size and at least a second resultant dot having a second size different from the first size formed thereon are oriented generally centrally about respective imaginary lattice points defining imaginary horizontal and vertical grid lines on the carried recording medium; and recording means for ejecting one or a plurality of ink droplets from the nozzles corresponding to the driven heating elements and impacting the ink droplet(s) on the recording medium, thus recording dots made of the ink droplet(s), wherein the time-divisional manner includes a number of time divisions and the number of time divisions is related to a number of simultaneously driven nozzles as follows:

$$t_{max}=T/P \quad (1)$$

$$A=t/\tau \quad (2)$$

$$n=N/A \quad (3)$$

and $$m\times n\leqq A \quad (4)$$

where $t_{max}$ is a maximum ink ejection frequency;

T is a time period for printing a head width in one row by a line head for one color capable of color printing;

P is a pulse number of a conventional Pulse number modulation system;

t is less than $t_{max}$;

$\tau$ is an ejection pulse width;

N is a total number of nozzles;

A is a maximum number of time divisions;

n is the number of simultaneously driven nozzles rounded out to a whole number; and m is a number of time divisions.

18. The recording head as claimed in claim 17, wherein the time-division driving means drives the heating elements on the basis of a division dive signal generated for said each set and an element drive signal generated by the drive signal generating means for driving the heating elements belonging to said set designated by the division drive signal.

19. The recording head as claimed in claim 18, wherein the time-division driving means generates the division drive signals corresponding to the number of time divisions by multi-dimensional input signals.

20. The recording head as claimed in claim 17, wherein the drive signal generating means has:

storage means for storing record data made up of necessary data for forming one dot;

pulse generating means for generating pulses for determining the number of said ink droplets to be ejected from the nozzles; and comparing means for comparing the record data stored in the storage means with the number of pulses generated by the pulse generating means;

the drive signal generating means outputting the result of comparison made by the comparing means as the element drive signal.

21. The recording head as claimed in claim 20, wherein the drive signal generating means determines the order of the pulses to be objects of comparison with the record data so that a dot to be formed on the recording medium is equivalent to a dot formed by distributing the ink droplets in the direction of carrying the recording medium from a lattice point as the center, which is the position on the recording medium in forming one dot with one said ink droplet.

22. The recording head as claimed in claim 21, wherein in the case of forming one dot with the ink droplets of even ordinal numbers, the drive signal generating means determines the order of the pulses to be objects of comparison with the record data so that the resultant dot is equivalent to a dot formed by distributing the ink droplets of odd ordinal numbers and the ink droplets of even ordinal numbers in the direction of carrying the recording medium symmetrically about the lattice point as the center, and in the case of forming one dot with the ink droplets of odd ordinal numbers, the drive signal generating means determines the order of the pulses to be objects of comparison with the record data so that the resultant dot is equivalent to a dot formed by impacting the first ink droplet on the lattice point and then distributing the ink droplets of odd ordinal numbers and the ink droplets of even ordinal numbers in the direction of carrying the recording medium symmetrically about the lattice point as the center.

23. The recording head as claimed in claim 21, wherein the recording means carries out recording while changing the position on the recording medium where the ink droplet should be impacted, in accordance with the number of pulses generated by the drive signal generating means.

24. An ink jet printer having a recording head having a plurality of heating elements as driving elements for ejecting ink droplets from a plurality of nozzles, the plurality of heating elements being arranged in a direction substantially perpendicular to the direction of carrying a carried recording medium, the ink jet printer being adapted for recording information including a character or an image in the form of dots made of ink droplets, the ink jet printer comprising:

head drive circuit for generating an element drive signal made of necessary data for forming one dot so as to modulate the diameter of a dot by the number of ink droplets, using one or a plurality of ink droplets for forming one dot;

electric circuit unit for dividing the plurality of heating elements into a plurality of blocks, each block consisting of a predetermined number of spatially arranged heating elements of the plurality of heating elements corresponding to the plurality of nozzles, and sequentially driving each set of heating elements and corresponding nozzles simultaneously driven over the respective blocks, in a time-divisional manner in a driving order in which none of the next-driven heating elements is adjacent to any of the immediately previously-driven heating elements;

correcting circuit for correcting unevenness of print density by controlling pulse number modulation by adding or subtracting pulses for ejecting ink droplets in quantities fixed by the respective nozzles to compensate at least in part for desired target quantities of ink droplets to correct unevenness of print density; and head chip of ejecting one or a plurality of ink droplets from the nozzles corresponding to the driven heating elements and impacting the ink droplet(s) on the recording medium, thus recording dots made of the ink droplet(s), wherein the time-divisional manner includes a number of time divisions and the number of time divisions is related to a number of simultaneously driven nozzles as follows;

$$t_{max}=T/P \quad (1)$$

$$A=t/\tau \quad (2)$$

$$n=N/A \quad (3)$$

and $$m\times n\leqq A \quad (4)$$

where $t_{max}$ is a maximum ink ejection frequency;

T is a time period for printing a head width in one row by a line head for one color capable of color printing;

P is a pulse number of a conventional pulse number modulation system;

t is less than $t_{max}$;

$\tau$ is an ejection pulse width;

N is a total number of nozzles;

A is a maximum number of time divisions;

n is the number of simultaneously driven nozzles rounded out to a whole number; and m is a number of time divisions.

25. The ink jet printer as claimed in claim 24, wherein the electric circuit unit drives the heating elements on the basis of a division dive signal generated for said each set and an element drive signal generated by the head drive circuit for driving the heating elements belonging to said set designated by the division drive signal.

26. The ink jet printer as claimed in claim 25, wherein the electric circuit unit generates the division drive signals corresponding to the number of time divisions by multi-dimensional input signals.

27. The ink jet printer as claimed in claim 24, wherein the head drive circuit has:

a memory for storing record data made up of necessary data for forming one dot;

a pulse generator for generating pulses for determining the number of said ink droplets to be ejected from the nozzles; and a comparator for comparing the record data stored in the memory with the number of pulses generated by the pulse generator;

the hard drive circuit outputting the result of comparison made by the comparing means as the element drive signal.

28. The ink jet printer as claimed in claim 27, wherein the head drive circuit determines the order of the pulses to be objects of comparison with the record data so that a dot to be formed on the recording medium is equivalent to a dot formed by distributing the ink droplets in the direction of carrying the recording medium from a lattice point as the center, which is the position on the recording medium in forming one dot with one said ink droplet.

29. The inkjet printer as claimed in claim 28, wherein in the case of forming one dot with the ink droplets of even ordinal numbers, the head drive circuit determines the order of the pulses to be objects of comparison with the record data so that the resultant dot is equivalent to a dot formed by distributing the ink droplets of odd ordinal numbers and the ink droplets of even ordinal numbers in the direction of carrying the recording medium symmetrically about the lattice point as the center, and in the case of forming one dot with the ink droplets of odd ordinal numbers, the head drive circuit determines the order of the pulses to be objects of comparison with the record data so that the resultant dot is equivalent to a dot formed by impacting the first ink droplet on the lattice point and then distributing the ink droplets of odd ordinal numbers and the ink droplets of even ordinal numbers in the direction of carrying the recording medium symmetrically about the lattice point as the center.

30. The ink jet printer as claimed in claim 28, wherein the head chip carries out recording while changing the position on the recording medium where the ink droplet should be impacted, in accordance with the number of pulses generated by the head drive circuit.

* * * * *